US011174449B2

(12) United States Patent
Hussain et al.

(10) Patent No.: US 11,174,449 B2
(45) Date of Patent: Nov. 16, 2021

(54) SEAL SWELL AGENTS FOR LUBRICATING COMPOSITIONS

(71) Applicant: The Lubrizol Corporation, Wickliffe, OH (US)

(72) Inventors: Mahmud M. Hussain, Ann Arbor, MI (US); Peter Miatt, Allestree (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 16/303,163

(22) PCT Filed: May 22, 2017

(86) PCT No.: PCT/US2017/033804
§ 371 (c)(1),
(2) Date: Nov. 20, 2018

(87) PCT Pub. No.: WO2017/205274
PCT Pub. Date: Nov. 30, 2017

(65) Prior Publication Data

US 2019/0292478 A1 Sep. 26, 2019

Related U.S. Application Data

(60) Provisional application No. 62/340,700, filed on May 24, 2016.

(51) Int. Cl.

| | |
|---|---|
| ***C10M 135/10*** | (2006.01) |
| ***C10N 30/02*** | (2006.01) |
| ***C10N 30/00*** | (2006.01) |
| ***C10N 40/04*** | (2006.01) |
| ***C10N 40/25*** | (2006.01) |
| ***C10N 40/30*** | (2006.01) |

(52) U.S. Cl.
CPC .. *C10M 135/10* (2013.01); *C10M 2203/1025* (2013.01); *C10M 2205/0285* (2013.01); *C10M 2219/044* (2013.01); *C10N 2030/02* (2013.01); *C10N 2030/36* (2020.05); *C10N 2040/04* (2013.01); *C10N 2040/042* (2020.05); *C10N 2040/25* (2013.01); *C10N 2040/30* (2013.01)

(58) Field of Classification Search
CPC ..... C10M 135/10; C10M 2219/044; C10M 2203/1025; C10M 2205/0285; C10N 2030/02; C10N 2030/36; C10N 2040/04; C10N 2040/042; C10N 2040/25; C10N 2040/30
See application file for complete search history.

(56) References Cited

U.S. PATENT DOCUMENTS

| | | | | |
|---|---|---|---|---|
| 2,236,168 | A * | 3/1941 | Dietrich | C10M 1/08 508/548 |
| 2,269,282 | A | 1/1942 | Moran | |
| 2,678,923 | A | 5/1954 | Hansford | |
| 4,029,587 | A | 6/1977 | Koch | |
| 4,029,588 | A | 6/1977 | Koch | |
| 5,591,503 | A | 1/1997 | Pews et al. | |
| 5,731,273 | A | 3/1998 | Field | |
| 6,207,624 | B1 | 3/2001 | Stachew et al. | |
| 2003/0104951 | A1 * | 6/2003 | Rajewski | C10M 145/36 508/110 |
| 2004/0119046 | A1 | 6/2004 | Carey et al. | |
| 2007/0298984 | A1 | 12/2007 | Konzman | |
| 2008/0287326 | A1 | 11/2008 | Zhang et al. | |
| 2009/0005274 | A1 | 1/2009 | Swartele | |
| 2012/0135904 | A1 * | 5/2012 | Kamano | C10M 135/10 508/548 |
| 2012/0149618 | A1 * | 6/2012 | Yamaguchi | C10M 139/00 508/291 |
| 2014/0038864 | A1 | 2/2014 | Shough et al. | |

FOREIGN PATENT DOCUMENTS

| | | |
|---|---|---|
| DE | 1620665 | 6/1970 |
| EP | 0168625 | 1/1986 |
| EP | 0466297 A1 | 1/1992 |
| EP | 2444474 A1 | 4/2012 |
| EP | 2530119 | 12/2012 |

OTHER PUBLICATIONS

Marie-Laure Teyssot et al., "Bis-Heteronucleophilic Michael Addition to Divinyl Sulfone: A New Efficient Access to Macrocycles", European Journal of Organic Chemistry, vol. 2003, No. 1, Jan. 1, 2003, pp. 54-62.

* cited by examiner

*Primary Examiner* — James C Goloboy
(74) *Attorney, Agent, or Firm* — Iken Sans; Teresan Gilbert; Teresan W. Gilbert

(57) ABSTRACT

A composition comprising an oil of lubricating viscosity and a compound represented by formula (I) wherein: x is 0 or 1; $R^1$ is a hydrocarbyl group containing about 4 or about 18 carbon atoms; $R^2$ is an aliphatic hydrocarbyl group containing about 1 to about 12 carbon atoms; and y is 0 or 1, which composition is effective at swelling seals.

(I)

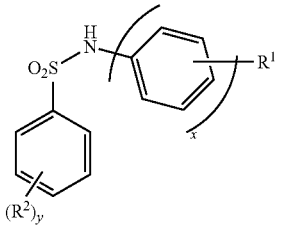

15 Claims, No Drawings

SEAL SWELL AGENTS FOR LUBRICATING COMPOSITIONS

CROSS REFERENCE TO RELATED APPLICATION

This application claims priority from PCT Application Serial No. PCT/US2017/033804 filed on May 22, 2017, which claims the benefit of U.S. Provisional Application No. 62/340,700 filed on May 24, 2016, both of which are incorporated in their entirety by reference herein.

BACKGROUND

The disclosed technology relates to compounds that are useful as seal swell agents in lubricant compositions. In particular, lubricating compositions and concentrates comprising said seal swell agents and the use of same are disclosed.

Rubber seals are critically important to the proper operation of many engines, axles, power transmission devices (including automatic and manual transmissions), pumps, gears, bearings, gas compressors and refrigerator systems. Seal performance tends to deteriorate with use and age; seals tend to degrade, harden, shrink and then leak. Preserving the integrity of seals in such devices is desirable, in order to lower maintenance costs of the operation and to prevent unexpected loss or leakage of lubricant that could result in catastrophic mechanical failure.

It is known to introduce seal swelling additives into functional fluids used in machinery in order to alleviate the problems of seal shrinkage and subsequent leakage of the functional fluid. The enhancement of swelling or apparent regeneration of elastomeric seals in machinery and equipment aids the prevention of leakage due to shrinkage of seals over time.

US 2007/0087947 A1 (Michael Glasgow et al., published on 19 Apr. 2007) discloses an additive composition which comprises at least one dispersant viscosity index improver and at least two seal swell additives. The two seal swell additives can be selected from oil-soluble esters and oil soluble sulfones such as the sulfolane seal well agents disclosed in U.S. Pat. Nos. 4,029,587 and 4,029,588.

U.S. Pat. No. 7,727,944 B2 (Edward J. Konzman et al., published on 1 Jun. 2010) discloses an additive composition which comprises a combination of conditioning agents for preserving the integrity of elastomeric materials. The composition can comprise as component (B), a second seal-conditioning agent which is a seal swell agent selected from the group consisting of sulfolanes, benzyl esters, lactones, nitriles and hindered phenolic materials.

Sulfolane-based seal swell additives suffer drawbacks in that they present manufacturing challenges; in particular, they are prepared from a solid raw material (sulfolene is a solid) which, as such, is not very practical to store and handle in a manufacturing process. There is a need for an alternative seal well additive that is easier to produce, for example one which can be produced more efficiently, using less resources.

As market usage of Group I base oils diminishes in favour of more refined base oils such as Group II, Group III, Group IV base oils, a need for more effective seal swell agents arises. These and modern base oils which are synthetic and/or non-polar tend to have low natural seal swelling activity. It has been found that prohibitively high concentrations of known seal swell agents may be required to impart seal swelling activity to fluids made with such base oils, including Group III, PAO (polyalphaolefin) and, more recently, GTL (gas-to-liquid) base oils. There is a need for a seal swell agent that can impart greater seal swelling properties to such fluids.

There is a need for compounds that can act as seal swell agents in lubricants and that impart excellent seal compatibility and, in particular, seal swelling properties to said lubricants.

It is the objective of the invention to meet one or more of the needs described above.

SUMMARY OF THE INVENTION

The disclosed technology provides a composition comprising an oil of lubricating viscosity and a compound represented by formula (I)

(I)

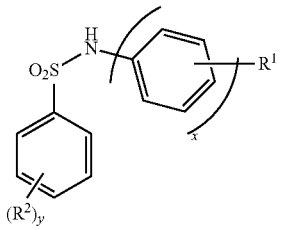

wherein: x is 0 or 1; $R^1$ is a hydrocarbyl group containing about 4 or about 18 carbon atoms; $R^2$ is an aliphatic hydrocarbyl group containing about 1 to about 12 carbon atoms; and y is 0 or 1.

The inventors have found that the compounds of formula (I) can impart exceptional seal swelling properties to an oil of lubricating viscosity. Lubricating compositions comprising a compound of formula (I) have excellent compatibility with elastomeric seals and are particularly effective at swelling such seals. It follows that a compound of formula (I) can be used as seal swell agent in a lubricating composition at a relatively low treat rate. This is advantageous for lubricating compositions comprising base oils with little natural seal swelling properties, such as synthetic gas-to-liquid oils, and which generally require a relatively high amount of seal swell additive to achieve seal swelling properties. Furthermore, the compounds of formula (I) can be produced more efficiently than prior art sulfolane seal swell agents as they can be produced from liquid reactants and no storage/handling of solid reactants is required.

In one embodiment, the compound of formula (I) may be present in an amount of 0.01 to 2 wt % based on the weight of the overall composition.

In one embodiment, the oil of lubricating viscosity is a Group II, Group III, Group IV or Gas-to-Liquid (Fischer-Tropsch) base oil, or mixture thereof.

The disclosed technology also provides a method of preparing such a lubricating composition comprising a compound of formula (I).

The disclosed technology also provides a method of lubricating a mechanical device using the composition of the invention.

In one embodiment, there is provided a method of lubricating a driveline device which has a seal in contact with a lubricating composition, said method comprising supplying to said driveline device a lubricating composition as disclosed herein.

In one embodiment, there is provided a method of lubricating an internal combustion engine which has a seal in contact with a lubricating composition, said method comprising supplying to said internal combustion engine a lubricating composition as disclosed herein.

In one embodiment, there is provided a method of lubricating a gas compressor which has a seal in contact with a lubricating composition, said method comprising supplying to said gas compressor a lubricating composition as disclosed herein.

In one embodiment, the invention provides a method of lubricating a refrigeration system which has a seal in contact with a lubricating composition, said method comprising supplying to said refrigeration system a lubricating composition as disclosed herein.

The disclosed technology also provides the use of a compound of formula (I) as a seal swelling or seal swell agent in a lubricating composition. The lubricating composition can be a lubricant for a driveline device, an internal combustion engine, a gas compressor or refrigeration system.

DETAILED DESCRIPTION OF THE INVENTION

Various preferred features and embodiments will be described below by way of non-limiting illustration.

The disclosed technology provides a compound of formula (I)

(I)

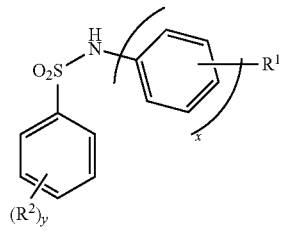

wherein: x is 0 or 1; $R^1$ is a hydrocarbyl group containing about 4 to about 18 carbon atoms; y is 0 or 1; and $R^2$ is an aliphatic hydrocarbyl group containing about 1 to about 12 carbon atoms.

$R^1$ is a hydrocarbyl group containing about 4 to about 18 carbon atoms. $R^1$ can be a hydrocarbyl group containing about 4 to about 12 carbon atoms, about 6 to about 12 carbon atoms, or about 6 to about 8 carbon atoms. In one embodiment, $R^1$ is an aliphatic hydrocarbyl group, such as an alkyl group. $R^1$ can be branched or linear. In one embodiment, $R^1$ does not include any ringed structures, i.e. any aromatic or non-aromatic ringed structures. Specific examples for $R^1$ include isobutyl, n-butyl, sec-butyl, n-hexyl, heptyl, 2-ethylhexyl, isooctyl, octyl, nonyl, isononyl, decyl, dodecyl, tetradecyl, hexadecyl, octadecyl, 9-octadecenyl.

In one embodiment, $R^1$ is a C8 to C12 aliphatic hydrocarbyl group. In this embodiment, $R^1$ can be linear or branched, e.g. a C8 to C12 linear or branched alkyl or group. For example, $R^1$ can be a branched alkyl group, with the branching at the beta position with respect to the nitrogen (as in 2-ethylhexyl). The beta position is the second carbon from the nitrogen atom. In this embodiment, specific examples for $R^1$ include 2-ethylhexyl, isooctyl, octyl, nonyl, isononyl, decyl and dodecyl.

When x is 1, $R^1$ can be attached to any of the carbons on the aromatic ring. In one embodiment, $R^1$ can be attached to the aromatic ring at the ortho or para position. The composition may also comprise a mixture of compounds wherein $R^1$ is in the ortho position with compounds wherein $R^1$ is in the para position. In one embodiment, $R^1$ is attached to the aromatic ring at the para position.

In one embodiment, x is 1 and y is 0. Alternatively, y is 1 and $R^2$ is an aliphatic hydrocarbyl group which contains 1 to 12, 1 to 8, or 1 to 4 carbon atoms. In one embodiment, $R^2$ is an aliphatic hydrocarbyl group which contains 1 to 4 carbon atoms and, for example, is an alkyl group chosen from methyl, ethyl, propyl and butyl groups. $R^2$ is not a hydroxyl group. When y is 1, $R^2$ can be attached to any of the carbons on the aromatic ring. In one embodiment, $R^2$ can be attached to the aromatic ring at the ortho or para position. The composition may also comprise a mixture of compounds wherein $R^2$ is in the ortho position with compounds wherein $R^2$ is in the para position. In one embodiment, $R^2$ is attached to the aromatic ring at the para position.

When x is 0, $R^1$ is attached directly to the nitrogen atom as is shown in formula (II) below:

(II)

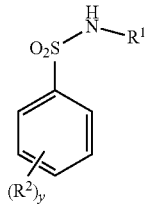

where $R^1$, $R^2$ and y are as defined previously for formula (I).

Preferably, when x is 0, $R^1$ is a hydrocarbyl group containing about 4 to about 8 carbon atoms. In one embodiment, x is 0 and y is 0. Alternatively, y is 1 and $R^2$ is an aliphatic hydrocarbyl group which contains 1 to 12, 1 to 8, or 1 to 4 carbon atoms. In one embodiment, $R^2$ is an aliphatic hydrocarbyl group which contains 1 to 4 carbon atoms and, for example, is an alkyl group chosen from methyl, ethyl, propyl and butyl groups. $R^2$ is not a hydroxyl group. When y is 1, $R^2$ can be attached to any of the carbons on the aromatic ring. In one embodiment, $R^2$ is attached to the aromatic ring at the para position.

The compounds of formula (I) are soluble in the oil of lubricating viscosity.

Example benzenesulfonamides according to formula (I) are shown in Table 1.

TABLE 1

| Cpd | Structure | Name |
|---|---|---|
| A | 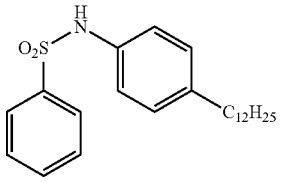 | N-(4-dodecylphenyl) benzenesulfonamide |
| B | 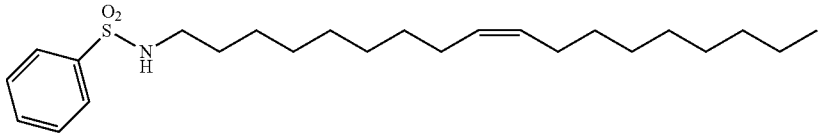 | (Z)-N-(octadec-9-en-1-yl)benzenesulfonamide |
| C | 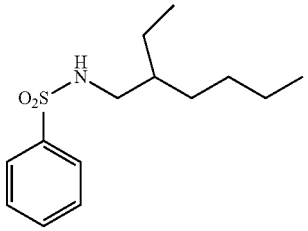 | N-(2-ethylhexyl) benzenesulfonamide |
| D | 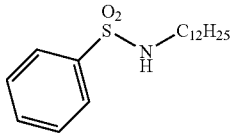 | N-dodecylbenzenesulfonamide |
| E | 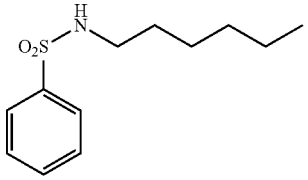 | N-hexylbenzenesulfonamide |
| F | 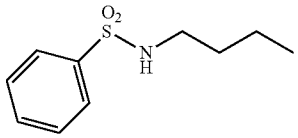 | N-butylbenzenesulfonamide |

The benzene sulfonamides of the invention can be prepared by reacting benzene sulfonyl chloride (or the appropriate hydrocarbyl-substituted benzene sulfonyl chloride) with the appropriate amine in equimolar ratio in the presence of triethylamine, as illustrated in the scheme below.

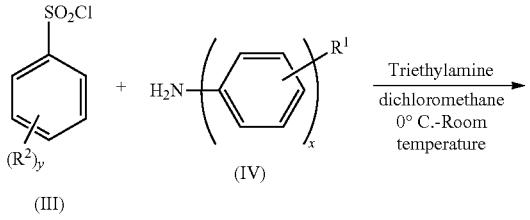

-continued

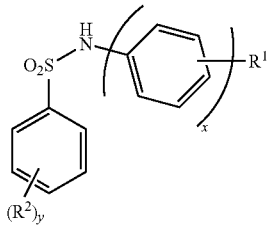

Advantageously, the reactants are liquid and thus are relatively easily stored and handled in a manufacturing plant. Thus the seal well additives of the invention are obtainable by the reaction of a compound of formula (III) and a compound of formula (IV), where x, y, $R^1$ and $R^2$ are as defined for formula (I) and (II) above, in an equimolar ratio in the presence of triethylamine. The reaction can be carried out in dichloromethane.

It has been found that compounds of formula (I) can be used to improve the seal compatibility of a lubricating composition and, in particular, to impart seal swelling properties to a lubricating composition, for example, a driveline oil (such as a transmission fluid or a lubricant for a gearbox or axle), an engine oil, or a lubricant for a gas compressor or refrigeration system.

The present technology provides a composition which comprises, as one component, an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties.

Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerized and interpolymerized olefins (e.g., polybutylenes, polypropylenes, propylene-isobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyl s, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof.

Other synthetic lubricating oils include polyol esters (such as Priolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid (GTL) synthetic procedure as well as other gas-to-liquid (GTL) oils.

GTL base oils include base oils obtained by one or more possible types of GTL processes, typically a Fischer-Tropsch process. The GTL process takes natural gas, predominantly methane, and chemically converts it to synthesis gas, or syngas. Alternatively, solid coal can also be converted into synthesis gas. Synthesis gas mainly contains carbon monoxide (CO) and hydrogen ($H_2$), which are mostly subsequently chemically converted to paraffins by a catalytic Fischer-Tropsch process. These paraffins will have a range of molecular weights and by the use of catalysts can be hydroisomerised to produce a range of base oils. GTL base stocks have a highly paraffinic character, typically greater than 90% saturates. Of these paraffinics, the non-cyclic paraffinic species predominate over the cyclic paraffinic species. For example, GTL base stocks typically comprise greater than 60 wt %, or greater than 80 wt %, or greater than 90 wt % non-cyclic paraffinic species. GTL base oils typically have a kinematic viscosity at 100° C. of between 2 cSt and 50 cSt, or 3 cSt to 50 cSt, or 3.5 cSt to 30 cSt. The GTL exemplified in this instance has a kinematic viscosity at 100° C. of about 4.1 cSt. Likewise, the GTL base stocks are typically characterised as having a viscosity index (VI, refer to ASTM D2270) of 80 or greater, or 100 or greater, or 120 or greater. The GTL exemplified in this instance has a VI of 129. Typically GTL base fluids have effectively zero sulphur and nitrogen contents, generally less than 5 ppm of each of these elements. GTL base stocks are Group III oils, as classified by the American Petroleum Institute (API).

Oils of lubricating viscosity may also be defined as specified in the American Petroleum Institute (API) Base Oil Interchangeability Guidelines. The five base oil groups are as follows: Group I (sulfur content >0.03 wt %, and/or <90 wt % saturates, viscosity index 80 to less than 120); Group II (sulfur content ≤0.03 wt %, and ≥90 wt % saturates, viscosity index 80 to less than 120); Group III (sulfur content ≤0.03 wt %, and ≥90 wt % saturates, viscosity index ≥120); Group IV (all polyalphaolefins (PAOs)); and Group V (all others not included in Groups I, II, III, or IV). The oil of lubricating viscosity may also be an API Group II+ base oil, which term refers to a Group II base oil having a viscosity index greater than or equal to 110 and less than 120, as described in SAE publication "Design Practice: Passenger Car Automatic Transmissions", fourth Edition, AE-29, 2012, page 12-9, as well as in U.S. Pat. No. 8,216,448, column 1 line 57.

The oil of lubricating viscosity may be an API Group IV oil, or mixtures thereof, i.e., a polyalphaolefin. Poly-alpha olefin base oils (PAOs), and their manufacture, are generally well known. With regards PAOs, the PAO base oils may be derived from linear C2 to C32, preferably C4 to C16, alpha olefins. Particularly preferred feedstocks for PAOs are 1-octene, 1-decene, 1-dodecene and 1-tetradecene. The polyalphaolefin may be prepared by metallocene catalyzed processes or from a non-metallocene process. The PAO exemplified in this instance has a kinematic viscosity at 100° C. of about 3.96 cSt and a VI of 101.

The oil of lubricating viscosity may comprise an API Group I, Group II, Group III, Group IV, Group V oil or mixtures thereof.

Often the oil of lubricating viscosity is an API Group I, Group II, Group II+, Group III, Group IV oil or mixtures thereof. Alternatively the oil of lubricating viscosity is often an API Group II, Group II+, Group III or Group IV oil or mixtures thereof. Alternatively the oil of lubricating viscosity is often an API Group II, Group II+, Group III oil or mixtures thereof.

In one embodiment, the oil of lubricating viscosity has little natural ability to swell seals, for example, a PAO or GTL oil. Both PAO and GTL base stocks are highly paraffinic in nature (low levels of aromaticity). PAOs are 100% isoparaffinic with essentially zero percent aromatics. Likewise, GTL base oils have a very highly paraffinic content and again, essentially zero aromatic content. As a result, both PAO and GTL base oils are regarded as having low solvency and poor lubricant additive solubility performance. They also exhibit little natural ability to swell seals.

In one embodiment, the oil of lubricating viscosity is a Group II, Group III, Group IV or Gas-to-Liquid (Fischer-Tropsch) oil, or mixtures thereof.

The amount of the oil of lubricating viscosity present is typically the balance remaining after subtracting from 100 wt % the amount of the compound of formula (I) and, when present, other performance additives.

The composition may be in the form of a concentrate or a fully formulated lubricant. If the composition is in the form of a fully formulated lubricant, typically the oil of lubricating viscosity, including any diluent oil present in the composition, will be present in an amount of from 70 to 95 wt %, or from 80 or 85 to 93 wt %.

If the lubricating composition of the invention is in the form of a concentrate (which may then be combined with additional oil to form, in whole or in part, a finished lubricant), typically the oil of lubricating viscosity, including any diluent oil present in the composition, will be present in an amount of from 0.1 wt % to 40 wt % or 0.2 wt % to 35 wt % or 0.4 wt % to 30 wt % or 0.6 wt % to 25 wt % or 0.1 wt % to 15 wt % or 0.3 wt % to 6 wt %.

In some embodiments, the compositions of the invention are lubricating compositions which can include a compound of formula (I) in an amount from 0.01 or 0.05 to 2 wt %, or 0.01 or 0.05 to 1.5 wt %, 0.05 to 1 wt %, 0.15 to 1 wt %, 0.15 to 0.5 wt % of the overall composition on an oil free basis. If the oil of lubricating viscosity is one which has little natural ability to swell seals such as a gas to liquid oil or a polyalphaolefin, then more seal swell agent of the present invention may be needed and the lubricating composition may include a compound of formula (I) in an amount from 0.35 to 1.5 wt %, 0.35 to 1.25 wt %, 0.35 to 0.8 wt %, 0.4 to 0.6 wt % of the overall composition on an oil free basis. The balance of these lubricating compositions may be one or more additional additives as described below and a major amount of oil of lubricating viscosity including any diluent oil or similar material carried into the composition from one or more of the components described herein. By major amount is meant greater than 50 wt % based on the composition.

In some embodiments, the compositions of the invention are concentrates, which can also be referred to as additive concentrates or additive compositions, which can include a compound of formula (I) in an amount from 2 to 30 wt %, 4 to 25 wt % or 7.5 to 22 wt % of the overall composition on an oil free basis. These ranges are especially typical for concentrates for Off Highway (OH) applications. The balance of these compositions may be one or more additional additives as described below, and a minor amount of lubricating oil including any diluent oil or similar material carried into the composition from one or more of the components described herein. By minor amount is meant 50 wt % or less than 50 wt % based on the composition.

The invention provides for the use of such additive concentrates as seal swelling additives in a lubricating composition.

Other components may be present in amounts which are suitable to the end use to which the lubricant is to be employed. Lubricants for driveline devices such as automatic transmissions will typically have their own spectrum of additives; similarly lubricants for engine oils (passenger car, or heavy duty diesel, or marine diesel, or small two-cycle) will each have their characteristic additives, as will lubricants for industrial application such as for use in gas compressors or refrigeration systems, which additives are well known to those skilled in the art of lubricating such devices. In general, lubricant formulations can optionally include any of the following additives:

Dispersants

Dispersants are well known in the field of lubricants and include primarily what are sometimes referred to as "ashless" dispersants because (prior to mixing in a lubricating composition) they do not contain ash-forming metals and they do not normally contribute any ash forming metals when added to a lubricant. Dispersants are characterized by a polar group attached to a relatively high molecular weight hydrocarbon chain.

One class of dispersant is Mannich bases. These are materials which are formed by the condensation of a higher molecular weight, alkyl substituted phenol, an alkylene polyamine, and an aldehyde such as formaldehyde and are described in more detail in U.S. Pat. No. 3,634,515. Another class of dispersant is high molecular weight esters. These materials are similar to Mannich dispersants or the succinimides described below, except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022. Aromatic succinate esters may also be prepared as described in United States Patent Publication 2010/0286414. Other dispersants include polymeric dispersant additives, which are generally hydrocarbon-based polymers which contain polar functionality to impart dispersancy characteristics to the polymer.

In certain embodiments, the dispersant is prepared by a process that involves the presence of small amounts of chlorine or other halogen, as described in U.S. Pat. No. 7,615,521 (see, e.g., col. 4, lines 18-60 and preparative example A). Such dispersants typically have some carbocyclic structures in the attachment of the hydrocarbyl substituent to the acidic or amidic "head" group. In other embodiments, the dispersant is prepared by a thermal process involving an "ene" reaction, without the use of any chlorine or other halogen, as described in U.S. Pat. No. 7,615,521; dispersants made in this manner are often derived from high vinylidene (i.e. greater than 50% terminal vinylidene) polyisobutylene (see col. 4, line 61 to col. 5, line 30 and preparative example B). Such dispersants typically do not contain the above-described carbocyclic structures at the point of attachment. In certain embodiments, the dispersant is prepared by free radical catalyzed polymerization of high-vinylidene polyisobutylene with an ethylenically unsaturated acylating agent, as described in U.S. Pat. No. 8,067,347.

Dispersants may be derived from, as the polyolefin, high vinylidene polyisobutylene, that is, having greater than 50, 70, or 75% terminal vinylidene groups ($\alpha$ and $\beta$ isomers). In certain embodiments, a succinimide dispersant may be prepared by the direct alkylation route. In other embodiments it may comprise a mixture of direct alkylation and chlorine-route dispersants.

A preferred class of dispersants is the carboxylic dispersants. Carboxylic dispersants include succinic-based dispersants, which are the reaction product of a hydrocarbyl substituted succinic acylating agent with an organic hydroxy compound or, in certain embodiments, an amine containing at least one hydrogen attached to a nitrogen atom, or a mixture of said hydroxy compound and amine. The term "succinic acylating agent" refers to a hydrocarbon-substituted succinic acid or succinic acid-producing compound. Such materials typically include hydrocarbyl-substituted succinic acids, anhydrides, esters (including half esters) and halides. Succinimide dispersants are more fully described in U.S. Pat. Nos. 4,234,435 and 3,172,892.

Succinic based dispersants have a wide variety of chemical structures including typically structures such as

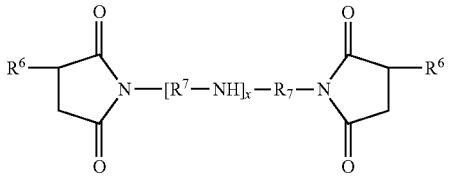

wherein each $R^6$ is independently a hydrocarbyl group, such as a polyolefin-derived group having an $\overline{M}_n$ of 500 or 700 to 10,000. Typically the hydrocarbyl group is an alkyl group, frequently a polyisobutyl group with a molecular weight of 500 or 700 to 5000, or in another embodiment, 1500 or 2000 to 5000. Alternatively expressed, the $R^6$ groups can contain 40 to 500 carbon atoms and in certain embodiments at least 50, e.g., 50 to 300 carbon atoms, such as aliphatic carbon atoms. Each $R^6$ group may contain one or more reactive groups, e.g., succinic groups. The $R^7$ are alkenyl groups, commonly —$C_2H_4$— groups. Such molecules are commonly derived from reaction of an alkenyl acylating agent with a polyamine, and a wide variety of linkages between the two moieties is possible beside the simple imide structure shown above, including a variety of amides and quaternary ammonium salts. Likewise a variety of modes of attachment of the $R^6$ groups are contemplated, including linkages involving cyclic (non-aromatic ring) structures.

The amines which are reacted with the succinic acylating agents to form the carboxylic dispersant composition can be monoamines or polyamines. Polyamines include principally alkylene polyamines such as ethylene polyamines (i.e., poly(ethyleneamine)s), such as ethylene diamine, triethylene tetramine, propylene diamine, decamethylene diamine, octamethylene diamine, di(heptamethylene)triamine, tripropylene tetramine, tetraethylene pentamine, trimethylene diamine, pentaethylene hexamine, di(-trimethylene)triamine. Higher homologues such as are obtained by condensing two or more of the above-illustrated alkylene amines likewise are useful. Tetraethylene pentamines is particularly useful.

Hydroxyalkyl-substituted alkylene amines, i.e., alkylene amines having one or more hydroxyalkyl substituents on the nitrogen atoms, likewise are useful, as are higher homologues obtained by condensation of the above-illustrated alkylene amines or hydroxy alkyl-substituted alkylene amines through amino radicals or through hydroxy radicals.

In one embodiment, the dispersant may be present as a single dispersant. In one embodiment, the dispersant may be present as a mixture of two or three different dispersants, wherein at least one may be a succinimide dispersant.

The succinimide dispersant may be a derivative of an aromatic amine, an aromatic polyamine, or mixtures thereof. The aromatic amine may be 4-aminodiphenylamine (ADPA) (also known as N-phenylphenylenediamine), derivatives of ADPA (as described in United States Patent Publications 2011/0306528 and 2010/0298185), a nitroaniline, an aminocarbazole, an amino-indazolinone, an aminopyrimidine, 4-(4-nitrophenylazo)aniline, or combinations thereof. In one embodiment, the dispersant is derivative of an aromatic amine wherein the aromatic amine has at least three non-continuous aromatic rings.

The succinimide dispersant may be a derivative of a polyether amine or polyether polyamine. Typical polyether amine compounds contain at least one ether unit and will be chain terminated with at least one amine moiety. The polyether polyamines can be based on polymers derived from C2-C6 epoxides such as ethylene oxide, propylene oxide, and butylene oxide. Examples of polyether polyamines are sold under the Jeffamine® brand and are commercially available from Hunstman Corporation located in Houston, Tex.

Post-treated dispersants may also be a part of the disclosed technology. They are generally obtained by reacting carboxylic, amine or Mannich dispersants with reagents such as urea, thiourea, carbon disulfide, aldehydes, ketones, carboxylic acids, hydrocarbon-substituted succinic anhydrides, nitriles, epoxides, boron compounds such as boric acid (to give "borated dispersants"), phosphorus compounds such as phosphorus acids or anhydrides, or 2,5-dimercaptothiadiazole (DMTD). Amine dispersants are reaction products of relatively high molecular weight aliphatic or alicyclic halides and amines, such as polyalkylene polyamines. Examples thereof are described in the U.S. Pat. Nos. 3,275,554, 3,438,757, 3,454,555, and 3,565,804. In certain embodiments one or more of the individual dispersants may be post-treated with boron or DMTD or with both boron and DMTD. Exemplary materials of these kinds are described in the following U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422.

The amount of the dispersant in a completely formulated lubricant, if present, will typically be 0.05 or 0.5 to 10 percent by weight, or 1 to 8 percent by weight, or 3 to 7 percent by weight or 2 to 5 percent by weight. Its concentration in a concentrate will be correspondingly increased, to, e.g., 5 to 80 weight percent.

Detergents

Detergents are generally salts of organic acids, which are often overbased. Metal overbased salts of organic acids are widely known to those of skill in the art and generally include metal salts wherein the amount of metal present exceeds the stoichiometric amount. Such salts are said to have conversion levels in excess of 100% (i.e., they comprise more than 100% of the theoretical amount of metal needed to convert the acid to its "normal" or "neutral" salt). They are commonly referred to as overbased, hyperbased or superbased salts and are usually salts of organic sulfur acids, organic phosphorus acids, carboxylic acids, phenols or mixtures of two or more of any of these. As a skilled worker would realize, mixtures of such overbased salts can also be used.

The overbased compositions can be prepared based on a variety of well-known organic acidic materials including sulfonic acids, carboxylic acids (including substituted salicylic acids), phenols, phosphonic acids, saligenins, salixarates, and mixtures of any two or more of these. These materials and methods for overbasing of them are well known from numerous U.S. Patents.

The basically reacting metal compounds used to make these overbased salts are usually an alkali or alkaline earth metal compound, although other basically reacting metal compounds can be used. Compounds of Ca, Ba, Mg, Na and Li, such as their hydroxides and alkoxides of lower alkanols are usually used. Overbased salts containing a mixture of ions of two or more of these metals can be used in the present invention.

Overbased materials are generally prepared by reacting an acidic material (typically an inorganic acid or lower carboxylic acid, such as carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter. The acidic organic compound will, in the present instance, be the above-described saligenin derivative.

The acidic material used in preparing the overbased material can be a liquid such as formic acid, acetic acid, nitric acid, or sulfuric acid. Acetic acid is particularly useful. Inorganic acidic materials can also be used, such as HCl, $SO_2$, $SO_3$, $CO_2$, or $H_2S$, e.g., $CO_2$ or mixtures thereof, e.g., mixtures of $CO_2$ and acetic acid.

Patents specifically describing techniques for making basic salts of acidic organic compounds generally include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Overbased saligenin derivatives are described in PCT publication WO 2004/048503; overbased salixarates are described in PCT publication WO 03/018728.

Overbased sulphonates typically have a TBN of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. The predominantly linear alkylbenzene sulphonate detergent may be particularly useful for assisting in improving fuel economy. In one embodiment the sulphonate detergent may be a metal salt of one or more oil-soluble alkyl toluene sulphonate compounds as disclosed in paragraphs [0046] to [0053] of US Patent Application 2008/0119378.

In one embodiment, the sulfonate detergent may be a branched alkylbenzene sulfonate detergent. Branched alkylbenzene sulfonate may be prepared from isomerized alpha olefins, oligomers of low molecular weight olefins, or combinations thereof. Preferred oligomers include tetramers, pentamers, and hexamers of propylene and butylene. In other embodiments, the alkylbenzene sulfonate detergent may be derived from a toluene alkylate, i.e. the alkylbenzene sulfonate has at least two alkyl groups, at least one of which is a methyl group, the other being a linear or branched alkyl group as described above.

In one embodiment the lubricating composition further comprises a non-sulphur containing phenate, or sulphur containing phenate, or mixtures thereof. The non-sulphur containing phenates and sulphur containing phenates and known in the art. The non-sulphur containing phenate, or sulphur containing phenate may be neutral or overbased. Typically an overbased non-sulphur containing phenate, or a sulphur containing phenate have a total base number of 180 to 450 TBN and a metal ratio of 2 to 15, or 3 to 10. A neutral non-sulphur containing phenate, or sulphur containing phenate may have a TBN of 80 to less than 180 and a metal ratio of 1 to less than 2, or 0.05 to less than 2.

The non-sulphur containing phenate, or sulphur containing phenate may be in the form of a calcium or magnesium non-sulphur containing phenate, or sulphur containing phenate (typically calcium non-sulphur containing phenate, or sulphur containing phenate). When present the non-sulphur containing phenate, or sulphur containing phenate may be present at 0.1 to 10 wt %, or 0.5 to 8 wt %, or 1 to 6 wt %, or 2.5 to 5.5 wt % of the lubricating composition.

In one embodiment the lubricating composition may be free of an overbased phenate, and in a different embodiment the lubricating composition may be free of a non-overbased phenate. In another embodiment the lubricating composition may be free of a phenate detergent.

Phenate detergents are typically derived from p-hydrocarbyl phenols. Alkylphenols of this type may be coupled with sulfur and overbased, coupled with aldehyde and overbased, or carboxylated to form salicylate detergents. Suitable alkylphenols include those alkylated with oligomers of propylene, i.e. tetrapropenylphenol (i.e. p-dodecylphenol or PDDP) and pentapropenylphenol. Other suitable alkylphenols include those alkylated with alpha-olefins, isomerized alpha-olefins, and polyolefins like polyisobutylene. In one embodiment, the lubricating composition comprises less than 0.2 wt %, or less than 0.1 wt %, or even less than 0.05 wt % of a phenate detergent derived from PDDP. In one embodiment, the lubricant composition comprises a phenate detergent that is not derived from PDDP. In one embodiment, the lubricating composition comprises a phenate detergent prepared from PDDP wherein the phenate detergent contains less than 1.0 weight percent unreacted PDDP, or less than 0.5 weight percent unreacted PDDP, or substantially free of PDDP.

In one embodiment the lubricating composition further comprises a salicylate detergent that may be neutral or overbased. The salicylates are known in the art. The salicylate detergent may have a TBN of 50 to 400, or 150 to 350, and a metal ratio of 0.5 to 10, or 0.6 to 2. Suitable salicylate detergents included alkylated salicylic acid, or alkylsalicylic acid. Alkylsalicylic acid may be prepared by alkylation of salicylic acid or by carbonylation of alkylphenol. When alkylsalicylic acid is prepared from alkylphenol, the alkylphenol is selected in a similar manner as the phenates described above. In one embodiment, alkylsalicylate of the invention include those alkylated with oligomers of propylene, i.e. tetrapropenylphenol (i.e. p-dodecylphenol or PDDP) and pentapropenylphenol. Other suitable alkylphenols include those alkylated with alpha-olefins, isomerized alpha-olefins, and polyolefins like polyisobutylene. In one embodiment, the lubricating composition comprises a salicylate detergent prepared from PDDP wherein the phenate detergent contains less than 1.0 weight percent unreacted PDDP, or less than 0.5 weight percent unreacted PDDP, or substantially free of PDDP.

When present, the salicylate may be present at 0.01 to 10 wt %, or 0.1 to 6 wt %, or 0.2 to 5 wt %, 0.5 to 4 wt %, or 1 to 3 wt % of the lubricating composition.

The detergents generally can also be borated by treatment with a borating agent such as boric acid. Typical conditions include heating the detergent with boric acid at 100 to 150° C., the number of equivalents of boric acid being roughly equal to the number of equivalents of metal in the salt. U.S. Pat. No. 3,929,650 discloses borated complexes and their preparation.

The amount of the detergent component in a completely formulated lubricant, if present, will typically be 0.01 to 15 percent by weight, 0.5 to 10 percent by weight, such as 1 to 7 percent by weight, or 1.2 to 4 percent by weight. Its concentration in a concentrate will be correspondingly increased, to, e.g., 5 to 65 weight percent.

Anti-Wear Agents—Phosphorus Containing Materials

The compositions of the present invention can also include at least one phosphorus acid, phosphorus acid salt, phosphorus acid ester or derivative thereof including sulfur-containing analogs. The phosphorus acids, salts, esters or derivatives thereof include phosphoric acid, phosphorous acid, phosphorus acid esters or salts thereof, phosphites, phosphorus-containing amides, phosphorus-containing carboxylic acids or esters, phosphorus-containing ethers, and mixtures thereof.

In one embodiment, the phosphorus acid, ester or derivative can be an organic or inorganic phosphorus acid, phosphorus acid ester, phosphorus acid salt, or derivative thereof. The phosphorus acids include the phosphoric, phosphonic, phosphinic, and thiophosphoric acids including dithiophosphoric acid as well as the monothiophosphoric, thiophosphinic and thiophosphonic acids. One group of phosphorus compounds are alkylphosphoric acid mono alkyl primary amine salts as represented by the formula

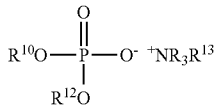

where $R^{10}$, $R^{12}$, $R^{13}$ are alkyl or hydrocarbyl groups or one of $R^{12}$ and $R^{12}$ can be H. The materials can be a 1:1 mixture of dialkyl and monoalkyl phosphoric acid esters. Compounds of this type are described in U.S. Pat. No. 5,354,484.

Other phosphorus-containing materials that may be present include dialkyl-phosphites (sometimes referred to as dialkyl hydrogen phosphonates) such as dibutyl phosphite. Yet other phosphorus materials include phosphorylated hydroxy-substituted triesters of phosphorothioic acids and amine salts thereof, as well as sulfur-free hydroxy-substituted di-esters of phosphoric acid, sulfur-free phosphorylated hydroxy-substituted di- or tri-esters of phosphoric acid, and amine salts thereof. These materials are further described in U.S. patent application US 2008-0182770.

The composition of the invention can include metal salts of a phosphorus acid such as metal salts of the formula

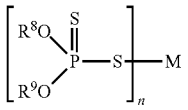

wherein $R^8$ and $R^9$ are independently hydrocarbyl groups containing 3 to 30 carbon atoms are readily obtainable by the reaction of phosphorus pentasulfide ($P_2S_3$) and an alcohol or phenol to form an O,O-dihydrocarbyl phosphorodithioic acid corresponding to the formula

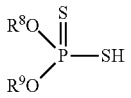

The metal M, having a valence n, generally is aluminum, lead, tin, manganese, cobalt, nickel, zinc, or copper, and in certain embodiments, zinc. The basic metal compound can thus be zinc oxide, and the resulting metal compound is represented by the formula

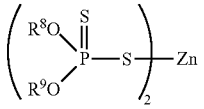

The $R^8$ and $R^9$ groups are independently hydrocarbyl groups that may be free from acetylenic and usually also from ethylenic unsaturation. They are typically alkyl, cycloalkyl, aralkyl or alkaryl group and have 3 to 20 carbon atoms, such as 3 to 16 carbon atoms or up to 13 carbon atoms, e.g., 3 to 12 carbon atoms. The alcohols which react to provide the $R^8$ and $R^9$ groups can be one or more primary alcohols, one or more secondary alcohols, a mixture of secondary alcohol and primary alcohol. A mixture of two secondary alcohols such as isopropanol and 4-methyl-2-pentanol is often desirable.

Such materials are often referred to as zinc dialkyldithiophosphates or simply zinc dithiophosphates. They are well known and readily available to those skilled in the art of lubricant formulation.

The amount of the metal salt of a phosphorus acid in a completely formulated lubricant, if present, will typically be 0.01 to 6 percent by weight, 0.1 to 5 percent by weight, such as 0.3 to 2 percent by weight, or 0.5 to 1.5 percent by weight. Its concentration in a concentrate will be correspondingly increased, to, e.g., 5 to 60 weight percent.

Friction Modifiers

Another component that may be used in the composition used in the present technology is a friction modifier. Friction modifiers are well known to those skilled in the art. A list of friction modifiers that may be used is included in U.S. Pat. Nos. 4,792,410, 5,395,539, 5,484,543 and 6,660,695. U.S. Pat. No. 5,110,488 discloses metal salts of fatty acids and especially zinc salts, useful as friction modifiers. A list of friction modifiers that may be used may include: fatty phosphites; borated alkoxylated fatty amines; fatty acid amides; metal salts of fatty acids; fatty epoxides; sulfurized olefins; borated fatty epoxides; fatty imidazolines; fatty amines; condensation products of carboxylic acids and polyalkylene-polyamines; glycerol esters; metal salts of alkyl salicylates; borated glycerol esters; amine salts of alkylphosphoric acids; alkoxylated fatty amines; ethoxylated alcohols; oxazolines; imidazolines; hydroxyalkyl amides; polyhydroxy tertiary amines; and mixtures of two or more thereof.

Representatives of each of these types of friction modifiers are known and are commercially available. For instance, fatty phosphites may be generally of the formula $(RO)_2PHO$ or $(RO)(HO)PHO$ where R may be an alkyl or alkenyl group of sufficient length to impart oil solubility. Suitable phosphites are available commercially and may be synthesized as described in U.S. Pat. No. 4,752,416.

Borated fatty epoxides that may be used are disclosed in Canadian Patent No. 1,188,704. These oil-soluble boron-containing compositions may be prepared by reacting a boron source such as boric acid or boron trioxide with a fatty epoxide which may contain at least 8 carbon atoms. Non-borated fatty epoxides may also be useful as supplemental friction modifiers.

Borated amines that may be used are disclosed in U.S. Pat. No. 4,622,158. Borated amine friction modifiers (including borated alkoxylated fatty amines) may be prepared by the reaction of a boron compounds, as described above, with the corresponding amines, including simple fatty amines and hydroxy containing tertiary amines. The amines useful for preparing the borated amines may include commercial alkoxylated fatty amines known by the trademark "ETHOMEEN" and available from Akzo Nobel, such as bis[2-hydroxyethyl]-cocoamine, polyoxyethylene[10]cocoamine, bi s[2-hydroxyethyl]soyamine, bis[2-hydroxyethyl]allowamine, polyoxyethylene-[5]tallowamine, bis[2-hydroxyethyl]oleylamine, bis[2-hydroxyethyl]

octadecylamine, and polyoxyethylene[15]octadecylamine. Such amines are described in U.S. Pat. No. 4,741,848.

Alkoxylated fatty amines and fatty amines themselves (such as oleylamine) may be useful as friction modifiers. These amines are commercially available.

Both borated and unborated fatty acid esters of glycerol may be used as friction modifiers. Borated fatty acid esters of glycerol may be prepared by borating a fatty acid ester of glycerol with a boron source such as boric acid. Fatty acid esters of glycerol themselves may be prepared by a variety of methods well known in the art. Many of these esters, such as glycerol monooleate and glycerol tallowate, are manufactured on a commercial scale. Commercial glycerol monooleates may contain a mixture of 45% to 55% by weight monoester and 55% to 45% by weight diester.

Fatty acids may be used in preparing the above glycerol esters; they may also be used in preparing their metal salts, amides, and imidazolines, any of which may also be used as friction modifiers. The fatty acids may contain 6 to 24 carbon atoms, or 8 to 18 carbon atoms. A useful acid may be oleic acid.

The amides of fatty acids may be those prepared by condensation with ammonia or with primary or secondary amines such as diethylamine and diethanolamine. Fatty imidazolines may include the cyclic condensation product of an acid with a diamine or polyamine such as a polyethylenepolyamine. In one embodiment, the friction modifier may be the condensation product of a C8 to C24 fatty acid with a polyalkylene polyamine, for example, the product of isostearic acid with tetraethylenepentamine. The condensation products of carboxylic acids and polyalkyleneamines may be imidazolines or amides.

The fatty acid may also be present as its metal salt, e.g., a zinc salt. These zinc salts may be acidic, neutral, or basic (overbased). These salts may be prepared from the reaction of a zinc containing reagent with a carboxylic acid or salt thereof. A useful method of preparation of these salts is to react zinc oxide with a carboxylic acid. Useful carboxylic acids are those described hereinabove. Suitable carboxylic acids include those of the formula RCOOH where R is an aliphatic or alicyclic hydrocarbon radical. Among these are those wherein R is a fatty group, e.g., stearyl, oleyl, linoleyl, or palmityl. Also suitable are the zinc salts wherein zinc is present in a stoichiometric excess over the amount needed to prepare a neutral salt. Salts wherein the zinc is present from 1.1 to 1.8 times the stoichiometric amount, e.g., 1.3 to 1.6 times the stoichiometric amount of zinc, may be used. These zinc carboxylates are known in the art and are described in U.S. Pat. No. 3,367,869. Metal salts may also include calcium salts. Examples may include overbased calcium salts.

Sulfurized olefins are also well known commercial materials used as friction modifiers. A suitable sulfurized olefin is one which is prepared in accordance with the detailed teachings of U.S. Pat. Nos. 4,957,651 and 4,959,168. Described therein is a cosulfurized mixture of 2 or more reactants selected from the group consisting of at least one fatty acid ester of a polyhydric alcohol, at least one fatty acid, at least one olefin, and at least one fatty acid ester of a monohydric alcohol. The olefin component may be an aliphatic olefin, which usually will contain 4 to 40 carbon atoms. Mixtures of these olefins are commercially available. The sulfurizing agents useful in the process of the present invention include elemental sulfur, hydrogen sulfide, sulfur halide plus sodium sulfide, and a mixture of hydrogen sulfide and sulfur or sulfur dioxide.

Metal salts of alkyl salicylates include calcium and other salts of long chain (e.g. C12 to C16)alkyl-substituted salicylic acids.

Amine salts of alkylphosphoric acids include salts of oleyl and other long chain esters of phosphoric acid, with amines such as tertiary-aliphatic primary amines, sold under the tradename Primene™.

Eighty-five percent phosphoric acid is a suitable material for addition to the fully-formulated compositions to increase frictional properties and can be included at a level of 0.01-0.3 weight percent based on the weight of the composition, such as 0.03 to 0.2 or to 0.1 percent.

The amount of friction modifier, if it is present, may be 0.01 to 10 or 5 percent by weight of the lubricating composition, 0.1 to 2.5 percent by weight of the lubricating composition, such as 0.1 to 2.0, 0.2 to 1.75, 0.3 to 1.5 or 0.4 to 1 percent. In some embodiments, however, the amount of friction modifier is present at less than 0.2 percent or less than 0.1 percent by weight, for example, 0.01 to 0.1 percent.

Viscosity Modifiers

Other additives may be present in the lubricants of the disclosed technology. One component frequently used is a viscosity modifier. Viscosity modifiers (VM) and dispersant viscosity modifiers (DVM) are well known. Examples of VMs and DVMs may include polymethacrylates, polyacrylates, polyolefins, styrene-maleic ester copolymers, and similar polymeric substances including homopolymers, copolymers, and graft copolymers. The DVM may comprise a nitrogen-containing methacrylate polymer, for example, a nitrogen-containing methacrylate polymer derived from methyl methacrylate and dimethylaminopropylamine.

Examples of commercially available VMs, DVMs and their chemical types may include the following: polyisobutylenes (such as Indopol™ from BP Amoco or Parapol™ from ExxonMobil); olefin copolymers (such as Lubrizol™ 7060, 7065, and 7067 from Lubrizol and Lucant™ HC-2000L and HC-600 from Mitsui); hydrogenated styrene-diene copolymers (such as Shellvis™ 40 and 50, from Shell and LZ® 7308, and 7318 from Lubrizol); styrene/maleate copolymers, which are dispersant copolymers (such as LZ® 3702 and 3715 from Lubrizol); polymethacrylates, some of which have dispersant properties (such as those in the Viscoplex™ series from RohMax, the Hitec™ series from Afton, and LZ 7702™, LZ7727™, LZ7725™ and LZ 7720C™ from Lubrizol); olefin-graft-polymethacrylate polymers (such as Viscoplex™ 2-500 and 2-600 from RohMax); and hydrogenated polyisoprene star polymers (such as Shellvis™ 200 and 260, from Shell). Also included are Asteric™ polymers from Lubrizol(methacrylate polymers with radial or star architecture). Viscosity modifiers that may be used are described in U.S. Pat. Nos. 5,157,088, 5,256,752 and 5,395,539. The VMs and/or DVMs may be used in the functional fluid at a concentration of up to 20% or 60% or 70% by weight. Concentrations of 0.1 to 12%, 0.1 to 4%, 0.2 to 3%, 1 to 12% or 3 to 10% by weight may be used.

Antioxidants

Other materials can optionally be included in the compositions of the present technology, provided that they are not incompatible with the afore-mentioned required components or specifications. Such materials include antioxidants (that is, oxidation inhibitors), including hindered phenolic antioxidants, secondary aromatic amine antioxidants such as dinonyldiphenylamine as well as such well-known variants as monononyldiphenylamine and diphenylamines with other alkyl substituents such as mono- or di-ocyl, sulfurized phenolic antioxidants, oil-soluble copper compounds, phosphorus-containing antioxidants, and organic sulfides, disulfides, and polysulfides such as 2-hydroxyalkyl, alkyl thioethers or 1-t-dodecylthio-2-propanol or sulfurized 4-carbobutoxycyclohexene or other sulfurized olefins.

The amount of anti-oxidant, if it is present, may be 0.01 to 5 or 3 percent by weight of the lubricating composition, or 0.3 to 1.2 percent by weight of the lubricating composition, such as 0.5 to 1.2, 0.6 to 1.0 or 0.7 to 0.9 or 0.15 to 4.5, or 0.2 to 4, percent by weight.

Other Additives

The compositions of the present invention may also include, or exclude, conventional amounts of other components which are commonly found in lubricating compositions.

Also included may be corrosion inhibitors or metal deactivators such as tolyl triazole and dimercaptothiadiazole and oil-soluble derivatives of such materials. These include derivatives of benzotriazole (typically tolyltriazole), 1,2,4-triazole, benzimidazole, 2-alkyldithiobenzimidazole or 2-alkyldithiobenzothiazole, 1-amino-2-propanol, a derivative of dimercaptothiadiazole, octylamine octanoate, condensation products of dodecenyl succinic acid or anhydride and/or a fatty acid such as oleic acid with a polyamine.

Other optional components include additional seal swell additives, such as isodecyl sulfolane or phthalate esters, which are designed to keep seals pliable.

Other materials are anti-wear agents such as tridecyl adipate, and various long-chain derivatives of hydroxy carboxylic acids, such as tartrates, tartramides, tartrimides, and citrates as described in US Application 2006-0183647. These optional materials are known to those skilled in the art and are generally commercially available. Yet other commercially available anti-wear gents include dimercaptothiadizoles and their derivatives, which are described in greater detail in published European Patent Application 761,805.

Also included can be known materials such as, demulsifiers dyes, fluidizing agents, odor masking agents, and antifoam agents. Demulsifiers include trialkyl phosphates, and various polymers and copolymers of ethylene glycol, ethylene oxide, propylene oxide, or mixtures thereof different from the non-hydroxy terminated acylated polyether of the disclosed technology. Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125-162. Foam inhibitors that may be useful in the compositions of the disclosed technology include polysiloxanes, copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Also included may be extreme pressure agents, chlorinated aliphatic hydrocarbons; boron-containing compounds including organic borate esters and organic borate salts; and molybdenum compounds. Extreme Pressure (EP) agents include sulphur- and chlorosulphur-containing EP agents, chlorinated hydrocarbon EP agents and phosphorus EP agents. Examples of such EP agents include chlorinated wax; sulphurised olefins (such as sulphurised isobutylene), organic sulphides and polysulphides such as dibenzyldisulphide, bis-(chlorobenzyl)disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, di stearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described in U.S. Pat. No. 3,197,405). The polysulphides are generally characterized as having sulphur-sulphur linkages. Typically the linkages have about 2 to about 8 sulphur atoms, or about 2 to about 6 sulphur atoms, or 2 to about 4 sulphur atoms. In one embodiment the polysulphide contains at least about 20 wt %, or at least about 30 wt % of the polysulphide molecules contain three or more sulphur atoms. In one embodiment at least about 50 wt % of the polysulphide molecules are a mixture of tri- or tetra-sulphides. In other embodiments at least about 55 wt %, or at least about 60 wt % of the polysulphide molecules are a mixture of tri- or tetra-sulphides. In one embodiment up to about 90 wt % of the polysulphide molecules are a mixture of tri- or tetra-sulphides. In other embodiments up to about 80 wt % of the polysulphide molecules are a mixture of tri- or tetra-sulphides. The polysulphide in other embodiments contain about 0 wt % to about 20 wt %, or about 0.1 to about 10 wt % of a penta- or higher polysulphide. In one embodiment the polysulphide contains less than about 30 wt % or less than about 40 wt % of a disulphide in the polysulphide. The polysulphide typically provides about 0.5 to about 5 wt %, or about 1 to about 3 wt %, of sulphur to the lubricating composition.

Pour point depressants are a particularly useful type of additive, often included in the lubricating oils described herein, usually comprising substances such as polymethacrylates, styrene-based polymers, crosslinked alkyl phenols, or alkyl naphthalenes. See for example, page 8 of "Lubricant Additives" by C. V. Smalheer and R. Kennedy Smith (Lesius-Hiles Company Publishers, Cleveland, Ohio, 1967). Pour point depressants that may be useful in the compositions of the disclosed technology also include polyalphaolefins, esters of maleic anhydride-styrene copolymers, polyacrylates or polyacrylamides.

Additional antioxidants can also be included, typically of the aromatic amine or hindered phenol type. These and other additives which may be used in combination with the present invention are described in greater detail in U.S. Pat. No. 4,582,618 (column 14, line 52 through column 17, line 16, inclusive).

The compound of formula (I) may be suitable for use in lubricating compositions such as an engine lubricant for an internal combustion engine, a lubricating composition for a driveline device such as a gear oil, axle oil, drive shaft oil, traction oil, manual transmission oil, automatic transmission oil, off-highway oil (such as tractor oil) or automotive gear oil (AGO), or a lubricating composition for a gas compressor or refrigeration system.

Lubricating Composition for an Engine

In one embodiment the compound of the invention is used as seal swell agent in a lubricating composition for an internal combustion engine, i.e. a crankcase lubricant.

The internal combustion engine may comprise a steel surface, for example, on a cylinder bore, a cylinder block or a piston ring. The internal combustion engine may be a motorcycle, a passenger car, a heavy duty diesel internal combustion engine or a 2-stroke or 4-stroke marine diesel engine.

The lubricating composition can have at least one of: (i) a sulphur content of up to and including 0.5 wt %, less than 0.5 wt % or from 0.1 to 0.4 wt %; (ii) a phosphorus content of up to and including 0.15 wt %, less than 1.5 wt % or from 0.01 or 0.03 to 0.08, 0.10 or 0.12 wt %; and (iii) a sulphated ash content of 0.5 wt % to 1.1 or 1.5 wt % of the lubricating composition.

The lubricating composition comprises an oil of lubricating viscosity, for example, as described above. In one embodiment, the oil of lubricating viscosity is a Group II, Group III, Group IV or Gas-to-Liquid (Fischer-Tropsch) base oil, or mixture thereof.

A typical crankcase lubricant may contain an oil of lubricating viscosity, for example a Group I, Group II, Group III mineral oil or combinations thereof, with a kinematic viscosity of 3.6 to 7.5 $mm^2/s$, or 3.8 to 5.6 $mm^2/s$, or 4.0 to 4.8 $mm^2/s$.

In addition to the compound of formula (I), the engine lubricating composition may further include other additives, for example, selected from those described above, in the amounts indicated above. In one embodiment the disclosed technology provides a lubricating composition further comprising at least one of an overbased detergent (including, for example, overbased sulphonates and phenates), an antiwear agent, an antioxidant (including, for example, phenolic and aminic antioxidants), a friction modifier, a corrosion inhibitor, a dispersant (typically a polyisobutylene succinimide dispersant), a dispersant viscosity modifier, a viscosity modifier (typically an olefin copolymer such as an ethylene-propylene copolymer), or mixtures thereof. In one embodiment the disclosed technology provides a lubricating composition comprising a compound of formula (I) and further comprising an overbased detergent, an antiwear agent, an antioxidant, a friction modifier and a corrosion inhibitor.

Suitable overbased detergents are described in the "Detergents" section above. The engine oil lubricating composition of the invention can comprise an overbased detergent chosen from non-sulphur-containing phenates, sulphur-containing phenates, sulphonates, salixarates, salicyclates and mixtures thereof, or borated equivalents and mixture of borated equivalents thereof. The overbased detergent may be present at 0 wt % to 15 wt %, or 0.1 wt % to 10 wt %, or 0.2 wt % to 8 wt %, or 0.2 wt % to 3 wt %. For example in a heavy duty diesel engine the detergent may be present at 2 wt % to 3 wt % of the lubricating composition. For a passenger car engine the detergent may be present at 0.2 wt % to 1 wt % of the lubricating composition. In one embodiment, an engine lubricating composition further comprises at least one overbased detergent with a metal ratio of at least 3, or at least 8, or at least 15.

In one embodiment an engine lubricating composition may be a lubricating composition further comprising at least one antiwear agent. Suitable antiwear agents are described in the "Anti-wear Agents" section above and include titanium compounds, tartaric acid derivatives such as tartrate esters, amides or tartrimides, malic acid derivatives, citric acid derivatives, glycolic acid derivatives, oil soluble amine salts of phosphorus compounds, sulphurised olefins, metal dihydrocarbyldithio-phosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl)disulphides. The antiwear agent many be a phosphorus-containing antiwear agent. Typically the phosphorus-containing antiwear agent may be a zinc dialkyldithiophosphate, a phosphite, a phosphate, a phosphonate, and an ammonium phosphate salt, or mixtures thereof. Zinc dialkyldithiophosphates are known in the art. The antiwear agent may be present at 0 wt % to 6 or 3 wt %, or 0.1 wt % to 1.5 wt %, or 0.5 wt % to 0.9 wt % of the lubricating composition.

The composition can comprise a molybdenum compound. The molybdenum compound may be an antiwear agent or an antioxidant. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

Suitable antioxidants are described above under "Antioxidants". Antioxidants include sulphurised olefins, diarylamines, alkylated diaryl amines, hindered phenols, molybdenum compounds (such as molybdenum dithiocarbamates), hydroxyl thioethers, or mixtures thereof. In one embodiment the lubricant composition includes an antioxidant, or mixtures thereof. The antioxidant may be present at 0 wt % to 10 wt %, or 0.1 wt % to 6 wt %, or 0.5 wt % to 5 wt %, or 0.5 wt % to 3 wt %, or 0.3 wt % to 1.5 wt % of the lubricant composition.

Suitable friction modifiers are described above under "Friction Modifiers". Engine oil lubricants (i.e. crankcase lubricants), often include friction modifying additives that reduce dynamic friction between two surfaces, typically steel surfaces; this is carried out largely to improve fuel economy. Additives of this type are often referred to as "fatty" and include fatty acids, esters, amides, imides, amines, and combinations thereof. Examples of suitable friction reducing additives include glycerol mono-oleate, oleyl amide, ethoxylated tallow amine, oleyl tartrimide, fatty alkyl esters of tartaric acid, oleyl malimide, fatty alkyl esters of malic acid and combinations thereof. Alternatively, molybdenum additives may be used to reduce friction and improve fuel economy. Examples of molybdenum additives include dinuclear molybdenum dithiocarbamate complexes, for example Sakuralube™ 525 available from Adeka corp.; trinuclear molybdenum dithiocarbamate complexes; molybdenum amines, for example Sakuralube™ 710 available from Adeka corp.; mononuclear molybdenum dithiocarbamate complexes; molybdenum ester/amide additves, for example Molyvan® 855 available from Vanderbilt Chemicals, LLC; molybdated dispersants; and combinations thereof.

Useful corrosion inhibitors for an engine lubricating composition are described above and include those described in paragraphs 5 to 8 of WO2006/047486, octylamine octanoate, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Suitable dispersants are described above under "Dispersants". In one embodiment, the composition comprises a succinimide dispersant and this can be a borated or non-borated succinimide dispersant.

Suitable viscosity modifiers and dispersant viscosity modifiers are described above under "Viscosity modifiers". In one embodiment the lubricating composition of the disclosed technology further comprises a dispersant viscosity modifier. The dispersant viscosity modifier may be present at 0 to 10 wt %, or 0 wt % to 5 wt %, or 0 wt % to 4 wt %, or 0.05 wt % to 2 wt %, or 0.2 wt % to 1.2 wt % of the lubricating composition.

The engine lubricating composition may also comprise a foam inhibitor, pour point depressant, demulsifier, metal deactivator or additional seal swell agent or mixtures thereof. Suitable candidates are described above under "other additives".

In one embodiment the lubricating composition comprises a compound of the invention in an amount 0.01 to 1.5 weight percent of the composition; at least one ashless dispersant in an amount 0.5 to 6 weight percent; at least one metal containing overbased detergent in an amount 0.5 to 3 weight percent of the composition; at least one zinc-free anti-wear agent which is a phosphorus-containing compound, a sulfur- and phosphorus-free organic anti-wear agent, or mixtures thereof in an amount 0.01 to 2 weight percent of the composition; at least one ashless antioxidant (selected from hindered phenols and/or diarylamines) in an amount 0.2 to 5 weight percent of the composition; a polymeric viscosity index improver in an amount 0.0 to 6 weight percent of the composition and, optionally, one or more additional additives selected from corrosion inhibitors, foam inhibitors, additional seal swell agents, and pourpoint depressants.

An engine lubricating composition in different embodiments may have a composition as disclosed in the following table:

TABLE 2

| | Embodiments (wt %) | | |
|---|---|---|---|
| Additive | A | B | C |
| Compound of formula (I) | 0.05 to 2 | 0.1 to 1.2 | 0.25 to 0.75 |
| Ashless Dispersant | 0.05 to 10 | 0.75 to 6 | 1.5 to 5 |
| Antioxidant | 0.05 to 10 | 0.2 to 3 | 0.5 to 2 |
| Dispersant Viscosity Modifier | 0 or 0.05 to 5 | 0 or 0.05 to 4 | 0.05 to 2 |
| Overbased Detergent | 0 or 0.05 to 15 | 0.1 to 6 | 0.5 to 3 |
| Antiwear Agent | 0 or 0.05 to 6 | 0.05 to 4 | 0.1 to 2 |
| Friction Modifier | 0 or 0.05 to 10 | 0.5 to 8 | 1 to 6 |
| Viscosity Modifier | 0 or 0.05 to 10 | 0 or 0.05 to 8 | 0 or 0.05 to 6 |
| Any Other Performance Additive | 0.05 to 2 | 0.1 to 1.2 | 0.25 to 0.75 |
| Oil of Lubricating Viscosity | Balance to 100% | Balance to 100% | Balance to 100% |

The compositions of the present invention exhibit several advantages. Engine seals, for example, particularly in older vehicles, have a tendency to dry out and shrink over time, and a powerful seal swell agent may effectively re-swell and soften the dried seals, regenerating them so they will perform their originally intended function. Seal swell agents are useful, for example, in preventing deterioration of both Viton™ and nitrile rubber seals, as evaluated in the MTU (Michigan Technical University) seal screen test in a passenger car motor oil GF5 formulation, in which all candidates are evaluated initially at 1% concentration in the blend as a typical treat level at which seal swell performance is evaluated.

Lubricating Composition for a Driveline Device

In another embodiment, the compound of the invention is used as seal swell agent in a lubricating composition suitable for lubricating a driveline device such as a manual transmission, automatic transmission, axle, gear or drive shaft. The driveline device may be on an off highway vehicle such as a farm tractor. Off highway vehicles operate under harsher conditions than on-highway vehicles.

A lubricating composition for a driveline device may have a sulphur-content of greater than 0.05 wt %, or 0.4 wt % to 5 wt %, or 0.5 wt % to 3 wt %, 0.8 wt % to 2.5 wt %, 1 wt % to 2 wt %, 0.075 wt % to 0.5 wt %, or 0.1 wt % to 0.25 wt % of the lubricating composition.

A lubricating composition for a driveline device may have a phosphorus content of 100 ppm to 5000 ppm, or 200 ppm to 4750 ppm, 300 ppm to 4500 ppm, or 450 ppm to 4000 ppm. The phosphorus content may be 400 to 2000 ppm, or 400 to 1500 ppm, or 500 to 1400 ppm, or 400 to 900 ppm, or 500 to 850 ppm or 525 to 800 ppm.

The lubricating composition comprises an oil of lubricating viscosity, for example, as described above. In one embodiment, the oil of lubricating viscosity is a Group II, Group III, Group IV or Gas-to-Liquid (Fischer-Tropsch) base oil, or mixture thereof.

In addition to the compound of formula (I) as described herein, the driveline lubricating composition may include further additives, for example, selected from those described above, in the amounts indicated above. In one embodiment, the disclosed technology provides a lubricating composition further comprising at least one of an antiwear agent, a viscosity modifier (typically a polymethacrylate having linear, comb or star architecture), an overbased detergent (including, for example, overbased sulphonates, phenates and salicylates), a dispersant, a friction modifier, an antioxidant (including, for example, phenolic and aminic antioxidants), a dispersant viscosity modifier, and mixtures thereof. In one embodiment, the disclosed technology provides a lubricating composition comprising a compound of formula (I), an oil of lubricating viscosity and further comprising an antiwear agent, a viscosity modifier, and at least one of a dispersant and an overbased detergent. In this embodiment, the lubricating composition may further comprise a friction modifier.

Suitable antiwear agents are described above under "Antiwear agents" and include an oil soluble phosphorus amine salt antiwear agent such as an amine salt of a phosphorus acid ester or mixtures thereof. The amine salt of a phosphorus acid ester includes phosphoric acid esters and amine salts thereof; dialkyldithiophosphoric acid esters and amine salts thereof; phosphites; and amine salts of phosphorus-containing carboxylic esters, ethers, and amides; hydroxy substituted di or tri esters of phosphoric or thiophosphoric acid and amine salts thereof; phosphorylated hydroxy substituted di or tri esters of phosphoric or thiophosphoric acid and amine salts thereof; and mixtures thereof. The amine salt of a phosphorus acid ester may be used alone or in combination. In one embodiment the oil soluble phosphorus amine salt includes partial amine salt-partial metal salt compounds or mixtures thereof. In one embodiment the phosphorus compound further includes a sulphur atom in the molecule. Examples of the antiwear agent may include a non-ionic phosphorus compound (typically compounds having phosphorus atoms with an oxidation state of +3 or +5). In one embodiment the amine salt of the phosphorus compound may be ashless, i.e., metal-free (prior to being mixed with other components). The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or in other embodiments 8 to 26, or 10 to 20, or 13 to 19 carbon atoms.

Suitable viscosity modifiers and dispersant viscosity modifiers are described above under "Viscosity modifiers". Viscosity modifiers are usually polymers, including polyisobutenes, polymethacrylic acid esters, diene polymers, polyalkylstyrenes, esterified styrene-maleic anhydride copolymers, alkenylarene-conjugated diene copolymers, and polyolefins. Multifunctional viscosity improvers, which also have dispersant and/or antioxidancy properties are known and may optionally be used. The amount of viscosity modifier may range from 0.1 to 70 wt %, or 1 to 50 wt %, or 2 to 40 wt %. In an automotive gear oil, for example, the viscosity modifier and/or dispersant viscosity modifier may be present in the lubricating composition in an amount of 5 to 60 wt %, or 5 to 50 wt %, or 5 to 40 wt %, or 5 to 30 wt % or 5-20 wt %. Typically the viscosity modifier may be a polymethacrylate, or mixtures thereof.

A driveline device lubricating composition may contain a detergent such as described above under "Detergents". A driveline device lubricating composition may contain an overbased detergent that may or may not be borated. For example the lubricating composition may contain a borated overbased calcium or magnesium sulphonate detergent, or mixtures thereof. Suitable overbased detergents are described in the "Detergents" section above. The lubricating composition of the invention can comprise an overbased detergent chosen from non-sulphur-containing phenates, sulphur-containing phenates, sulphonates, salixarates, salicyclates and mixtures thereof, or borated equivalents and mixture of borated equivalents thereof. In an automotive gear oil, for example, the detergent may be present in the lubricating composition in an amount of 0.05 to 1 wt %, or 0.1 to 0.9 wt %. In a manual transmission fluid, for example, the detergent may be present in the lubricating composition in an amount of at least 0.1%, e.g., 0.14 to 4 wt %, or 0.2 to 3.5 wt %, or 0.5 to 3 wt %, or 1 to 2 wt %, or 0.5 to 4 wt %, or 0.6 to 3.5 wt % or, 1 to 3 wt %, or at least 1 wt %, e.g., 1.5 to 2.8 wt %. In one embodiment, the composition can comprise one or more detergents containing calcium. In this embodiment, the total amount of calcium provided by the detergent(s) to the lubricant may be 0.03 to 1 wt %, or 0.1 to 0.6 wt %, or 0.2 to 0.5 wt %.

Suitable dispersants are described above under "Dispersants". The dispersant may be a succinimide dispersant. In one embodiment the succinimide dispersant may be an N-substituted long chain alkenyl succinimide. The long chain alkenyl succinimide may include polyisobutylene succinimide, wherein the polyisobutylene from which it is derived has a number average molecular weight in the range 350 to 5000, or 500 to 3000, or 750 to 1150. In one embodiment the dispersant for a driveline device may be a post treated dispersant. The dispersant may be post treated with dimercaptothiadiazole, optionally in the presence of one or more of a phosphorus compound, a dicarboxylic acid of an aromatic compound, and a borating agent. In an automotive gear oil, or in a manual transmission fluid, for example, the dispersant may be present in the lubricating composition in an amount of at least 0.1 wt %, or at least 0.3 wt %, or at least 0.5 wt % and at most 5 wt % or 4 wt % or 3 wt % of 2 wt %.

Suitable friction modifiers are described above under "Friction Modifiers". Suitable friction modifiers include:

an amide, or thio amide, represented by the formula $R^3C(X)NR^1R^2$ where X is 0 or S and $R^1$ and $R^2$ are each independently hydrocarbyl groups of at least 6 (or 8 to 24 or 10 to 18) carbon atoms and $R^3$ is a hydroxyalkyl group of 1 to 6 carbon atoms or a group formed by the condensation of the hydroxyalkyl group, through a hydroxyl group thereof, with an acylating agent;

a tertiary amine being represented by the formula $R^4R^5NR^6$ wherein $R^4$ and $R^5$ are each independently alkyl groups of at least 6 carbon atoms and $R^6$ is a polyhydroxy-containing alkyl group or a polyhydroxy-containing alkoxyalkyl group;

N-substituted oxalic acid bisamide or amide-ester containing at least two hydrocarbyl groups of about 12 to about 22 (or 12 to 20 or 12 to 18 or 12 to 16 or 12 to 14 or 14 to 20 or 14 to 18 or 14 to 16) carbon atoms carbon atoms;

fatty imidazolines such as the cyclic condensation product of an acid with a diamine or polyamine such as a polyethylenepolyamine and, in one embodiment, the friction modifier may be the condensation product of a C8 to C24 fatty acid with a polyalkylene polyamine, for example, the product of isostearic acid with tetraethylenepentamine (the condensation products of carboxylic acids and polyalkyleneamines may be imidazolines or amides);

friction modifiers consisting of the reaction product of a carboxylic acid or a reactive equivalent thereof with an aminoalcohol, selected from the group consisting of tris-hydroxymethylaminomethane, 2-amino-2-ethyl-1,3-propanediol, 3-amino-1-propanol, 2-amino-1-propanol, 1-amino-2-propanol, 2-amino-2-methyl-1-propanol, 4-amino-1-butanol, 5-amino-1-pentanol, 2-amino-1-pentanol, 2-amino-1,2-propanediol, 2-amino-1,3-propanediol, 2-amino-2-methyl-1,3-propanediol, N-(2-hydroxyethyl)ethylenedi amine, N,N-bis(2-hydroxyethyl)ethylenedi amine, 1,3-diamino-2-hydroxypropane, N,N'-bis-(2-hydroxyethyl) ethylenediamine, and 1-aminopropyl-3-diisopropanol amine, wherein the friction modifier contains at least two branched chain alkyl groups, each containing at least 6 carbon atoms;

sulfurized olefins, such as sulfurized vegetable oil, lard oil or C16-18 olefins;

borate esters from the reaction product of boron trioxide and an epoxide having at least 8 carbon atoms, or 10 to 20 carbon atoms or comprises a straight chain hydrocarbyl group of 14 carbon atoms (see U.S. Pat. No. 4,584,115) and borate esters formed by the reaction of an alcohol and boric acid, wherein the alcohol is typically branched, & of C6 to C10, or C8 to C10 or C8;

ethoxylated amines;

phosphorus containing compounds such as phosphoric acid as friction stabilizer and di-(fatty)alkyl phosphites; and metal salts of fatty acids.

Friction modifiers (other than (a) a borated phospholipid, and (b) an amine salt of a phosphoric acid ester) also include fatty phosphonate esters, reaction products from fatty carboxylic acids reacted with guanidine, aminoguanidine, urea or thiourea, and salts thereof, fatty amines, esters such as borated glycerol esters, fatty phosphites, fatty acid amides, fatty epoxides, borated fatty epoxides, alkoxylated fatty amines, borated alkoxylated fatty amines, metal salts of fatty acids, or fatty imidazolines, condensation products of carboxylic acids and polyalkylene-polyamines. In an automotive or axle gear oil, for example, the friction modifier may be present in the lubricating composition in an amount of 1 to 5 wt %, or 2 to 4 wt %, or 2 to 3.5 wt %.

Suitable antioxidants are described above under "Antioxidants". Antioxidants include sulphurised olefins, diarylamines, alkylated diaryl amines, hindered phenols, molybdenum compounds (such as molybdenum dithiocarbamates), hydroxyl thioethers, or mixtures thereof.

The driveline lubricating composition may also comprise a foam inhibitor, pour point depressant, corrosion inhibitor, demulsifier, metal deactivator or additional seal swell agent or mixtures thereof. Suitable candidates are described above under "other additives". Corrosion inhibitors useful for a driveline device include 1-amino-2-propanol, amines, triazole derivatives including tolyl triazole, dimercaptothiadiazole derivatives, octylamine octanoate, condensation products of dodecenyl succinic acid or anhydride and/or a fatty acid such as oleic acid with a polyamine.

A driveline device lubricating composition in different embodiments may have a composition as disclosed in the following table:

TABLE 3

| | Embodiments (wt %) | | | |
|---|---|---|---|---|
| Additive | A | B | C | D |
| Compound of formula (I) | 0.01 or 0.05 to 1.5 | 0.01 or 0.05 to 1.5 | 0.1 to 1, or 0.05 to 1.5 | 0.2 to 0.5, or 0.05 to 1.5 |
| Dispersant | 1 to 4 | 0.1 to 10, 2 to 7 | 0 to 5 | 1 to 6 |
| Extreme Pressure Agent | 3 to 6 | 0 to 6 | 0 to 3 | 0 to 6 |
| Overbased Detergent | 0 to 1 | 0.01 to 3, 0.025 to 2 | 0.5 to 6 | 0.01 to 2 |
| Antioxidant | 0 to 5 | 0.01 to 10 or 2 | 0 to 3 | 0 to 2 |
| Antiwear Agent | 0.5 to 5 | 0.01 to 15 | 0.5 to 3 | 0.01 to 3 |
| Friction Modifier | 0 to 5 | 0.01 to 5 | 0.1 to 1.5 | 0 to 5 |
| Viscosity Modifier | 0.1 to 70 | 0.1 to 15 | 1 to 60 | 0.1 to 70 |
| Any Other Performance Additive | 0 to 10 | 0 to 8 or 10 | 0 to 6 | 0 to 10 |
| Oil of Lubricating Viscosity | Balance to 100% | Balance to 100% | Balance to 100% | Balance to 100% |

Footnote:
The viscosity modifier in the table above may also be considered as an alternative to an oil of lubricating viscosity.
Column A may be representative of an automotive or axle gear lubricant.
Column B may be representative of an automatic transmission lubricant.
Column C may be representative of an off-highway lubricant.
Column D may be representative of a manual transmission lubricant.

In one embodiment, the lubricating composition is an automatic transmission lubricant comprising: a compound of formula (I), dispersant in an amount of 0.1 to 10 wt %, a detergent in an amount of 0.025 to 3 wt % or when the detergent contains calcium, a detergent in an amount to contribute 130 to 600 ppm to the composition, a phosphorus containing compound in an amount of 0.01 to 0.3 wt %, an antiwear agent in an amount of 0.01 to 15 wt %, a viscosity modifier in an amount of 0 to 12 wt %, an antioxidant in an amount of 0 to 10 wt %, a corrosion inhibitor in an amount of 0.001 to 10 wt % and a friction modifier in an amount of 0.01 to 5 wt %.

In one embodiment, the lubricating composition is an automatic transmission lubricant comprising: a compound of formula (I), a dispersant in an amount of 0.2 to 7 wt %, a detergent in an amount of 0.1 to 1 wt % or when the detergent contains calcium, a detergent in an amount to contribute 160 to 400 ppm to the composition, a phosphorus containing compound in an amount of 0.03 to 0.2 wt %, an antiwear agent in an amount of 0.05 to 10 wt %, a viscosity modifier in an amount of 0.1 to 10 wt %, an antioxidant in an amount of 0.01 to 5 wt %, a corrosion inhibitor in an amount of 0.005 to 5 wt % and a friction modifier in an amount of 0.01 to 4 wt %.

In one embodiment, the lubricating composition is an automatic transmission lubricant comprising: a compound of formula (I), a dispersant in an amount of 0.3 to 6 wt %, a detergent in an amount of 0.1 to 8 wt % or when the detergent contains calcium, a detergent in an amount to contribute 0 to 250 ppm to the composition, a phosphorus containing compound in an amount of 0.03 to 0.1 wt %, an antiwear agent in an amount of 0.075 to 5 wt %, a viscosity modifier in an amount of 1 to 8 wt %, an antioxidant in an amount of 0.05 to 3 wt %, a corrosion inhibitor in an amount of 0.01 to 3 wt % and a friction modifier in an amount of 0.25 to 3.5 wt %.

In one embodiment, the lubricating composition is an automatic transmission lubricant comprising: a compound of formula (I), a dispersant in an amount of 1 to 5 wt %, a detergent containing calcium in an amount to contribute 1 to 200 ppm to the composition, an antiwear agent in an amount of 0.1 to 3 wt %, a viscosity modifier in an amount of 3 to 8 wt %, an antioxidant in an amount of 0.1 to 1.2 wt %, a corrosion inhibitor in an amount of 0.02 to 2 wt % and a friction modifier in an amount of 0.1 to 3 wt %.

In one embodiment, the lubricating composition is an automatic transmission lubricant comprising: a compound of formula (I), a detergent containing calcium in an amount to contribute 10 to 150 ppm to the composition, an antioxidant in an amount of 0.2 to 1 wt % and a friction modifier in an amount of 0.5 to 2.5 wt %.

In one embodiment, the lubricating composition is an automatic transmission lubricant comprising: a compound of formula (I), a detergent containing calcium in an amount to contribute 20 to 100 ppm to the composition, an antioxidant in an amount of 0.3 to 1 wt % and a friction modifier in an amount of 1 to 2.5 wt %.

In the above-described embodiments of automatic transmission lubricants, the lubricating composition may comprise an oil of lubricating viscosity chosen from a Group II, Group III, Group IV or Gas-to-Liquid (Fischer-Tropsch) base oil, or mixtures thereof.

Gas Compressor Lubricants

In one embodiment the lubricant disclosed herein may be a gas compressor or a refrigeration lubricant. The compound of formula (I) can be present in an amount of from 0.01 or 0.05 to 2 wt %, or 0.01 or 0.05 to 1.5 wt %, 0.05 to 1 wt %, 0.15 to 1 wt %, 0.15 to 0.5 wt % based on the weight of the lubricant. The working fluid can include a lubricant which comprises an oil of lubricating viscosity, for example, as described above. In one embodiment, the oil of lubricating viscosity is a Group II, Group III, Group IV or Gas-to-Liquid (Fischer-Tropsch) base oil, or mixture thereof. The working fluid can include a lubricant comprised of (i) one or more ester base oils, (ii) one or more mineral oil base oils, (iii) one or more polyalphaolefin (PAO) base oils, (iv) one more alkyl benzene base oils, (v) one or more polyalkylene glycol (PAG) base oils, (vi) one or more alkylated naphthalene base oils, (vii) one or more polyvinylether base oils, (viii) one or more polyolester (POE) base oils, or any combination thereof to form an oil of lubricating viscosity and 0.01 wt % to 2 wt % of a compound of formula (I).

The lubricant may be a working fluid in a compressor used for refrigeration or gas compression. In one embodiment the working fluid may be for a low Global Warming Potential (low GWP) refrigerant system. The working fluid can include a lubricant comprised of ester base oils, mineral oil base oils, polyalphaolefin base oils, polyalkylene glycol base oils or polyvinyl ether base oils alone or in combination to form an oil of lubricating viscosity and 0.01 wt % to 2 wt % of a compound of formula (I) and a refrigerant or gas to be compressed. The ester based oil includes an ester of one or more branched or linear carboxylic acids from C4 to C13. The ester is generally formed by the reaction of the described branched carboxylic acid and one or more polyols.

In some embodiments, the branched carboxylic acid contains at least 5 carbon atoms. In some embodiments, the branched carboxylic acid contains from 4 to 9 carbon atoms. In some embodiments, the polyol used in the preparation of the ester includes neopentyl glycol, glycerol, trimethylol propane, pentaerythritol, dipentaerythritol, tripentaerythritol, or any combination thereof. In some embodiments, the polyol used in the preparation of the ester includes neopentyl glycol, pentaerythritol, dipentaerythritol, or any combination thereof. In some embodiments, the polyol used in the preparation of the ester includes neopentyl glycol. In some embodiments, the polyol used in the preparation of the ester includes pentaerythritol. In some embodiments, the polyol used in the preparation of the ester includes dipentaerythritol.

In some embodiments, the ester is derived from (i) an acid that includes 2-methylbutanoic acid, 3-methylbutanoic acid, or a combination thereof and (ii) a polyol that includes neopentyl glycol, glycerol, trimethylol propane, pentaerythritol, dipentaerythritol, tripentaerythritol, or any combination thereof.

The lubricant may have the ability to provide an acceptable viscosity working fluid that has good miscibility.

By "acceptable viscosity" it is meant the ester based lubricant and/or the working fluid has a viscosity (as measured by ASTM D445 at 40° C.) of more than 4 $mm^2 s^{-1}$. In some embodiments, the ester based lubricant and/or the working fluid has a viscosity at 40° C. from 5 or 32 $mm^2 s^{-1}$ up to 320, 220, 120, or even 68 $mm^2 s^{-1}$.

As noted by above, by "low GWP", it is meant the working fluid has a GWP value (as calculated per the Intergovernmental Panel on Climate Change's 2001 Third Assessment Report) of not greater than 1000, or a value that is less than 1000, less than 500, less than 150, less than 100, or even less than 75. In some embodiments, this GWP value is with regards to the overall working fluid. In other embodiments, this GWP value is with regards to the refrigerant present in the working fluid, where the resulting working fluid may be referred to as a low GWP working fluid.

By "good miscibility" it is meant that the refrigerant or compressed gas and lubricant are miscible, at least at the operating conditions the described working fluid will see during the operation of a refrigeration or gas compression system. In some embodiments, good miscibility may mean that the working fluid (and/or the combination of refrigerant and lubricant) does not show any signs of poor miscibility other than visual haziness at temperatures as low as 0° C., or even −25° C., or even in some embodiments as low as −50° C., or even −60° C.

In some embodiments, the described working fluid may further include one or more additional lubricant components. These additional lubricant components may include (i) one or more esters of one or more linear carboxylic acids, (ii) one or more polyalphaolefin (PAO) base oils, (iii) one more alkyl benzene base oils, (iv) one or more polyalkylene glycol (PAG) base oils, (v) one or more alkylated naphthalene base oils, or (vi) any combination thereof.

Additional lubricants that may be used in the described working fluids include certain silicone oils and mineral oils.

Commercially available mineral oils include Sonneborn® LP 250 commercially available from Sonneborn, Suniso® 3GS, 1GS, 4GS, and 5GS, each commercially available from Sonneborn, and Calumet R015 and R030 commercially available from Calumet. Commercially available alkyl benzene lubricants include Zerol® 150 and Zerol® 300 commercially available from Shrieve Chemical. Commercially available esters include neopentyl glycol dipelargonate, which is available as Emery® 2917 and Hatcol® 2370. Other useful esters include phosphate esters, dibasic acid esters, and fluoroesters. Of course, different mixtures of different types of lubricants may be used.

In some embodiments, the described working fluid further includes one or more esters of one or more linear carboxylic acids.

The working fluids may also include one or more refrigerants. Suitable non-low GWP refrigerants useful in such embodiments are not overly limited. Examples include R-22, R-134a, R-125, R-143a, or any combination thereof. In some embodiments at least one of the refrigerants is a low GWP refrigerant. In some embodiments, all of the refrigerants present in the working fluid are low GWP refrigerants. In some embodiments, the refrigerant includes R-32, R-290, R-1234yf, R-1234ze(E), R-744, R-152a, R-600, R-600a or any combination thereof. In some embodiments, the refrigerant includes R-32, R-290, R-1234yf, R-1234ze(E) or any combination thereof. In some embodiments, the refrigerant includes R-32. In some embodiments the refrigerant includes R-290. In some embodiments, the refrigerant includes R-1234yf. In some embodiments, the refrigerant includes R-1234ze(E). In some embodiments, the refrigerant includes R-744. In some embodiments, the refrigerant includes R-152a. In some embodiments, the refrigerant includes R-600. In some embodiments, the refrigerant includes R-600a.

In some embodiments, the refrigerant includes R-32, R-600a, R-290, DR-5, DR-7, DR-3, DR-2, R-1234yf, R-1234ze(E), XP-10, HCFC-123, L-41A, L-41B, N-12A, N-12B, L-40, L-20, N-20, N-40A, N-40B, ARM-30A, ARM-21A, ARM-32A, ARM-41A, ARM-42A, ARM-70A, AC-5, AC-5X, HPR1D, LTR4X, LTR6A, D2Y-60, D4Y, D2Y-65, R-744, R-1270, or any combination thereof. In some embodiments, the refrigerant includes R-32, R-600a, R-290, DR-5, DR-7, DR-3, DR-2, R-1234yf, R-1234ze(E), XP-10, HCFC-123, L-41A, L-41B, N-12A, N-12B, L-40, L-20, N-20, N-40A, N-40B, ARM-30A, ARM-21A, ARM-32A, ARM-41A, ARM-42A, ARM-70A, AC-5, AC-5X, HPR1D, LTR4X, LTR6A, D2Y-60, D4Y, D2Y-65, R-1270, or any combination thereof.

It is noted that the described working fluids may in some embodiments also include one or more non-low GWP refrigerant, blended with the low GWP refrigerant, resulting in a low GWP working fluid. Suitable non-low GWP refrigerants useful in such embodiments are not overly limited. Examples include R-22, R-134a, R-125, R-143a, or any combination thereof.

The described working fluids, at least in regards to how they would be found in the evaporator of the refrigeration system in which they are used, may be from 5 to 50 wt % lubricant, and from 95 to 50 wt % refrigerant. In some embodiments, the working fluid is from 10 to 40 wt % lubricant, or even from 10 to 30 or 10 to 20 wt % lubricant.

The described working fluids, at least in regards to how they would be found in the sump of the refrigeration system in which they are used, may be from 1 to 50, or even 5 to 50 wt % refrigerant, and from 99 to 50 or even 95 to 50 wt % lubricant. In some embodiments, the working fluid is from 90 to 60 or even 95 to 60 wt % lubricant, or even from 90 to 70 or even 95 to 70, or 90 to 80 or even 95 to 80 wt % lubricant.

The described working fluids may include other components for the purpose of enhancing or providing certain functionality to the composition, or in some cases to reduce the cost of the composition.

The described working fluids may further include one or more performance additives. Suitable examples of performance additives include anti-oxidants, metal passivators and/or deactivators, corrosion inhibitors, anti-foams, anti-wear inhibitors, corrosion inhibitors, pour point depressants, viscosity improvers, tackifiers, metal deactivators, extreme pressure additives, friction modifiers, lubricity additives, foam inhibitors, emulsifiers, demulsifiers, acid catchers, or mixtures thereof.

In some embodiments, the lubricant compositions include an antioxidant. In some embodiments, the lubricant compositions include a metal passivator, wherein the metal passivator may include a corrosion inhibitor and/or a metal deactivator. In some embodiments, the lubricant compositions include a corrosion inhibitor. In still other embodiments, the lubricant compositions include a combination of a metal deactivator and a corrosion inhibitor. In still further embodiments, the the lubricant compositions include the combination of an anti-oxidant, a metal deactivator and a corrosion inhibitor. In any of these embodiments, the lubricant compositions include one or more additional performance additives.

The antioxidants include butylated hydroxytoluene (BHT), butylatedhydroxyanisole (BHA), phenyl-a-naphthylamine (PANA), octylated/butylated diphenylamine, high molecular weight phenolic antioxidants, hindered bis-phenolic anti-oxidant, di-alpha-tocopherol, di-tertiary butyl phenol. Other useful anti-oxidants are described in U.S. Pat. No. 6,534,454.

In some embodiments, the antioxidant includes one or more of:

(i) Hexamethylenebis(3,5-di-tert-butyl-4-hydroxyhydrocinnamate), CAS registration number 35074-77-2, available commercially from BASF;

(ii)N-phenylbenzenamine, reaction products with 2,4,4-trimethylpentene, CAS registration number 68411-46-1, available commercially from BASF;

(iii) Phenyl-a- and/or phenyl-b-naphthylamine, for example N-phenyl-ar-(1,1,3,3-tetramethylbutyl)-1-naphthalenamine, available commercially from BASF;

(iv) Tetrakis[methylene(3,5-di-tert-butyl-4-hydroxyhydrocinnamate)] methane, CAS registration number 6683-19-8;

(v) Thiodiethylenebis(3,5-di-tert-butyl-4-hydroxyhydrocinnamate), CAS registration number 41484-35-9, which is also listed as thiodiethylenebis(3,5-di-tert-butyl-4-hydroxy-hydro-cinnamate) in 21 C.F.R. § 178.3570;

(vi) Butylatedhydroxytoluene (BHT);

(vii) Butylatedhydroxyanisole (BHA), (viii) Bis(4-(1,1,3,3-tetramethylbutyl)phenyl)amine, available commercially from BASF; and (ix) Benzenepropanoic acid, 3,5-bis(1,1-dimethylethyl)-4-hydroxy-, thiodi-2,1-ethanediyl ester, available commercially from BASF.

The anti-oxidants may be present in the composition from 0 or 0.01% to 6.0% or from 0.02%, to 1%. The additive may be present in the composition at 1%, 0.5%, or less. These various ranges are typically applied to all of the anti-oxidants present in the overall composition. However, in some embodiments, these ranges may also be applied to individual antioxidants.

The metal passivators include both metal deactivators and corrosion inhibitors.

Suitable metal deactivators include triazoles or substituted triazoles. For example, tolyltriazole or tolutriazole may be utilized. Suitable examples of metal deactivator include one or more of:

(i) One or more tolu-triazoles, for example N,N-Bis(2-ethylhexyl)-ar-methyl-1H-benzotriazole-1-methanamine, CAS registration number 94270-86-70, sold commercially by BASF under the trade name Irgamet™ 39;

(ii) One or more fatty acids derived from animal and/or vegetable sources, and/or the hydrogenated forms of such fatty acids, for example Neo-Fat™ which is commercially available from AKZO Nobel Chemicals, Ltd.

Suitable corrosion inhibitors include one or more of:

(i)N-Methyl-N-(1-oxo-9-octadecenyl)glycine, CAS registration number 110-25-8;

(ii) Phosphoric acid, mono- and diisooctyl esters, reacted with tert-alkyl and (C12-C14) primary amines, CAS registration number 68187-67-7;

(iii) Dodecanoic Acid;

(iv) Triphenyl phosphorothionate, CAS registration number 597-82-0; and (v) Phosphoric acid, mono- and dihexyl esters, compounds with tetramethylnonylamines and C11-14 alkylamines.

In one embodiment, the metal passivator is comprised of a corrosion additive and a metal deactivator. One useful additive is the N-acyl derivative of sarcosine, such as an N-acyl derivative of sarcosine. One example is N-methyl-N-(1-oxo-9-octadecenyl)glycine. This derivative is available from BASF under the trade name SARKOSYL™ O.

Another additive is an imidazoline such as Amine O™ commercially available from BASF.

The metal passivator may be present in the composition from 0.01% to 6.0% or from 0.02%, to 0.1%. The additive may be present in the composition at 0.05% or less. These various ranges are typically applied to all of the metal passivator additives present in the overall composition. However, in some embodiments, these ranges may also be applied to individual corrosion inhibitors and/or metal deactivators. The ranges above may also be applied to the combined total of all corrosion inhibitors, metal deactivators and antioxidants present in the overall composition.

The compositions described herein may also include one or more additional performance additives. Suitable additives include antiwear inhibitors, rust/corrosion inhibitors and/or metal deactivators (other than those described above), pour point depressants, viscosity improvers, tackifiers, extreme pressure (EP) additives, friction modifiers, foam inhibitors, emulsifiers, demulsifiers and acid catchers.

To aid in preventing wear on the metal surface, the present invention may utilize anti-wear inhibitor/extreme pressure (EP) additive and friction modifiers. Anti-wear inhibitors, EP additives, and friction modifiers are available off the shelf from a variety of vendors and manufacturers. Some of these additives may perform more than one task. One product that may provide anti-wear, EP, reduced friction and corrosion inhibition is phosphorus amine salt such as Irgalube™ 349, which is commercially available from BASF. Another anti-wear/EP inhibitor/friction modifier is a phosphorus compound such as is triphenyl phosphothionate (TPPT), which is commercially available from BASF under the trade name Irgalube TPPT. Another anti-wear/EP inhibitor/friction modifier is a phosphorus compound such as is tricresyl phosphate (TCP), which is commercially available from Chemtura under the trade name Kronitex™ TCP. Another anti-wear/EP inhibitor/friction modifier is a phosphorus compound such as is t-butylphenyl phosphate, which is commercially available from ICL Industrial Products under the trade name Syn-O-Ad 8478. The anti-wear inhibitors, EP, and friction modifiers are typically 0.1% to 4% of the composition and may be used separately or in combination.

In some embodiments, the composition further includes an additive from the group comprising: viscosity modifiers include ethylene vinyl acetate, polybutenes, polyisobutylenes, polymethacrylates, olefin copolymers, esters of styrene maleic anhydride copolymers, hydrogenated styrene-diene copolymers, hydrogenated radial polyisoprene, alkylated polystyrene, fumed silicas, and complex esters; and tackifiers like natural rubber solubilized in oils.

The addition of a viscosity modifier, thickener, and/or tackifier provides adhesiveness and improves the viscosity and viscosity index of the lubricant. Some applications and environmental conditions may require an additional tacky surface film that protects equipment from corrosion and wear. In this embodiment, the viscosity modifier, thickener/tackifier is 1 to 20 wt % of the lubricant. However, the viscosity modifier, thickener/tackifier may be from 0.5 to 30 wt %. An example of a material Functional V-584 a Natural Rubber viscosity modifier/tackifier, which is available from Functional Products, Inc., Macedonia, Ohio. Another example is a complex ester CG 5000 that is also a multi-functional product, viscosity modifier, pour point depressant, and friction modifier from Inolex Chemical Co. Philadelphia, Pa.

Other oils and/or components may be also added to the composition in the range of 0.1 to 75% or even 0.1 to 50% or even 0.1 to 30%. These oils could include white petroleum oils, synthetic esters (as described in patent U.S. Pat. No. 6,534,454), severely hydro-treated petroleum oil (known in the industry as "Group II or III petroleum oils"), esters of one or more linear carboxylic acids, polyalphaolefin (PAO) base oils, alkyl benzene base oils, polyalkylene glycol (PAG) base oils, alkylated naphthalene base oils, or any combination thereof.

The lubricant can be used in a gas compressor system, where the gas compressor system includes a compressor and a working fluid, where the working fluid includes a lubricant and a gas.

The lubricant may also be able to allow for providing a method of operating a gas compressor system. The described method includes the step of: supplying to the gas compressor system a working fluid that includes a lubricant and a gas.

The lubricant can be used in a refrigeration system, where the refrigeration system includes a compressor and a working fluid, where the working fluid includes a lubricant and a refrigerant. Any of the working fluids described above may be used in the described refrigeration system.

The lubricant may also be able to allow for providing a method of operating a refrigeration system. The described method includes the step of: (I) supplying to the refrigeration system a working fluid that includes a lubricant and a refrigerant. Any of the working fluids described above may be used in the described methods of operating any of the described refrigeration systems.

The present methods, systems and compositions are thus adaptable for use in connection with a wide variety of heat transfer systems in general and refrigeration systems in particular, such as air-conditioning (including both stationary and mobile air conditioning systems), refrigeration, heat-pump, or gas compression systems such as are used in hydrocarbon gas processing or industrial gas processing systems. As used herein, the term "refrigeration system" refers generally to any system or apparatus, or any part or portion of such a system or apparatus, which employs a refrigerant to provide cooling and/or heating. Such refrigeration systems include, for example, air conditioners, electric refrigerators, chillers, or heat pumps.

TABLE 4

Gas Compressor Lubrican compositions

| | Embodiments (wt %) | | |
|---|---|---|---|
| Additive | A | B | C |
| Seal Swell Agent of the invention (compound of formula (I)) | 0.01 to 2.0 | 0.02 to 1.5 | 0.05 to 1.5 |
| Antioxidant | 0 to 6.0 | 0.01 to 3.0 | 0.03 to 2 |
| Antiwear/EP Agent | 0 to 4.0 | 0.0 to 2 | 0.1 to 1.0 |
| Metal Deactivator/ Corrosion Inhibitor | 0 to 6 | 0.0 to 0.5 | 0.015 to 0.1 |
| Oil of Lubricating Viscosity | Balance to 100% | Balance to 100% | Balance to 100% |

In order to demonstrate improved performance of the refrigerant composition, the composition may be evaluated versus control standards as to ASTM D471-12a Standard Test Method for Rubber Property—Effect of Liquids.

The invention also provides for a method of preparing the lubricating compositions disclosed herein. The method comprises mixing a compound of formula (I) with an oil of lubricating viscosity. The oil of lubricating viscosity can be, for example, as described above and, in one embodiment, the oil of lubricating viscosity is a Group II, Group III, Group IV or Gas-to-Liquid (Fischer-Tropsch) base oil, or mixture thereof. Further additives as disclosed above can be mixed in as well. This method is effectively a method of improving the elastomer seal compatibility of the oil of lubricating viscosity. The presence of the compound of formula (I) imparts seal swelling properties to the oil of lubricating viscosity.

The invention also provides for a method of lubricating a mechanical device which has a seal in contact with a lubricating composition, which method comprises supplying to said device the lubricating composition of the invention. The lubricating composition can be supplied either as the lubricating composition or as an additive concentrate. The method can involve an additional step of operating the mechanical device. The device can be a driveline device such as a transmission or axle, wherein the lubricating composition is an automatic transmission fluid, manual transmission fluid or an axle lubricant. The device can be an internal combustion engine, wherein the lubricating composition is an engine oil. The device can be a gas compressor or a refrigeration system.

The invention also provides for a method of swelling an elastomer seal when in contact with a lubricating composition, said method comprising adding to said lubricating composition a compound of formula (I) or an additive concentrate according to the invention. The invention thus provides for the use of a compound according to formula (I) as a seal swelling agent in a lubricating composition. The lubricating composition comprises an oil of lubricating viscosity, for example, as described above. In one embodiment, the oil of lubricating viscosity is a Group II, Group III, Group IV or Gas-to-Liquid (Fischer-Tropsch) base oil, or mixture thereof.

The seal may be an elastomer seal. Typical elastomer materials include ethylene acrylic elastomers, fluoroelastomers, chloroelastomers, polyacrylates and nitrile polymers. Preferably the elastomer is chosen from ethylene acrylic, fluoroelastomers, polyacrylates and nitrile polymers. More preferably the elastomer is chosen from fluoroelastomers, polyacrylates and nitrile polymers.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group. In one embodiment, there are no halo substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The following examples provide illustrations of the disclosed technology. These examples are non-exhaustive and are not intended to limit the scope of the disclosed technology.

Preparation of Compound A: N-(4-Dodecylphenyl)Benzenesulfonamide

N-(4-dodecylphenyl)benzenesulfonamide is prepared by reacting benzene sulfonyl chloride (20 g, 113 mmol) with p-dodecylaniline (29.6 g, 113 mmol) and triethylamine (2.9 g, 226 mmol) in dichloromethane (250 g) at 0° C. for 1 hour. The reaction is then allowed to warm to room temperature and stirred until the starting material is fully consumed. The crude reaction is quenched with saturated sodium bicarbonate solution followed by brine. The reaction mixture is dried with anhydrous magnesium sulfate, filtered and the solvent is stripped under reduced pressure to afford a dark yellow viscous liquid.

Preparation of Compound B: (Z)-N-(octadec-9-en-1-yl)benzenesulfonamide (Z)-N-(octadec-9-en-1-yl)benzenesulfonamide is prepared according to the same procedure detailed for compound A by reacting benzene sulfonyl chloride (20 g, 113 mmol) with oleyl amine (30.2 g, 113 mmol) and triethylamine (22.9 g, 226 mmol) in dichloromethane solvent.

Preparation of Compound C: N-(2-ethylhexyl)benzenesulfonamide

N-(2-ethylhexyl)benzenesulfonamide is prepared according to the same procedure detailed for compound A by reacting benzene sulfonyl chloride (20 g, 113 mmol) with 2-ethylhexyl amine (14.6 g, 113 mmol) and triethylamine (22.9 g, 226 mmol) in dichloromethane solvent.

Alternatively, compound C can be synthesized by reacting benzene sulfonyl chloride (683.3 g, 3.87 moles) with 2-ethylhexyl amine (500 g, 3.87 moles) in aqueous sodium hydroxide solution (700 g of 25 pbw NaOH solution). After the reaction is complete, the organic layer is separated and water is removed under reduced pressure. The mixture is filtered through diatomaceous earth (FAX-5) to yield a clear liquid product that crystallised into a low melting white solid on standing.

Preparation of Compound D: N-dodecylbenzenesulfonamide

N-dodecylbenzenesulfonamide is prepared according to the same procedure detailed for compound A by reacting benzene sulfonyl chloride (20 g, 113 mmol) with dodecan-1-amine (20.9 g, 113 mmol) and triethylamine (22.9 g, 226 mmol) in dichloromethane solvent.

Preparation of compound E: N-hexylbenzenesulfonamide

N-hexylbenzenesulfonamide is prepared according to the same procedure detailed for compound A by reacting benzene sulfonyl chloride (20 g, 113 mmol) with 1-hexylamine (11.4 g, 113 mmol) and triethylamine (22.9 g, 226 mmol) in dichloromethane solvent.

Compound F: N-butylbenzenesufonamide

N-butylbenzenesufonamide is commercially available (such as from Sigma-Aldrich).

Experiment 1—Automatic Transmission Fluid

The efficacy of compounds of formula (I) as seal swell agents is assessed by blending the compounds into typical or conventional lubricants for an automatic transmission and determining the degree of compatibility with elastomeric seal materials as per test methods outlined in Appendix B of the DEXRON®-VI specification (GMN10060, June 2005), available from General Motors). SAE approved Standard Reference Elastomers (SRE) are used.

In this assessment, the original volume measurement and Durometer readings (as per ASTM D4289) of each elastomer are recorded. Then, individual pieces of elastomer are suspended in 300 ml of the formulation under test, at 150° C. 1° C. for 504 hours. After a sample clean up step to remove surface lubricant, the volume and Durometer readings of each elastomer are recorded. The degree of volume change of the elastomeric seal material (i.e. swelling or shrinkage) is expressed as a percentage, and the hardness change of the elastomeric seal material is expressed as a points value. A reference oil is tested simultaneously using the same elastomers. The test is designed to determine the compatibility of the lubricating compositions with elastomeric seal materials. The assessment is carried out using one or more elastomers from a range of elastomers, including ethylene acrylic elastomers, fluoroelastomers, polyacrylates and nitriles.

Five lubricating compositions are prepared based on the formulation given below which represents a typical or conventional lubricant for an automatic transmission. Each of the components other than the oil is presented in an oil-free basis, and all the percentages are by weight:

Oil of lubricating viscosity: in an amount to total 100%
Antioxidants: 1.0
Antiwear component: 0.28
Corrosion inhibitors: 0.245
Detergents: 0.23
Dispersants: 3.04
Friction adjustor: 0.11
Friction modifiers: 1.22
Pour point depressant: 0.2
Antifoams: 135 ppm The lubricating compositions differ in the type of oil of lubricating viscosity that is used and in the identity of further additive added as shown in Table 5. The compositions which are examples of the present invention contain one of compounds C, E and F, which are compounds according to formula (I). The reference examples contain a commercially available seal swell agent (a sulfolane, which is a sulfolene-derived compound) which is a C10-rich 3-(C9-11-isoalkyloxy) derivative of tetrahydrothiophene 1,1-dioxide.

TABLE 5

| | Oil of lubricating viscosity | Further additive | Amount of further additive (wt %) |
|---|---|---|---|
| Reference Example 1 | PAO-4 | Sulfolane compound | 1.5 |
| Example 1 | GTL | Compound E | 1.5 |
| Example 2 | GTL | Compound F | 1.5 |
| Reference Example 2 | Yubase 4+ | Sulfolane compound | 1.5 |
| Example 3 | Yubase 4+ | Compound C | 1.5 |

In this experiment, the elastomeric seal compatibility of each composition is carried out on the nitrile (N1) elastomer and the results are shown in Table 6. For volume change, a positive number (percent) indicates that the elastomer material has undergone a positive volume change. For hardness change, a lower number indicates that the elastomer material has increased in suppleness. The results show that each elastomer material swells more (i.e. the percentage increase in volume is greater) when the composition of the invention is used compared to when the composition of the relevant Reference Example (no further additive) is used. It is assumed that each of the oils of lubricating viscosity used in Example 1 and Reference Example 1, i.e. GTL and PAO-4, exhibit a similar low level of natural seal swelling activity.

TABLE 6

| | Volume change (%) | Hardness change (points) |
|---|---|---|
| Reference Example 1 | 0.69 | −3 |
| Example 1 | 3.02 | −4 |
| Example 2 | 1.74 | −4 |
| Reference Example 2 | 1.32 | −2 |
| Example 3 | 2.3 | −6 |

Experiment 2—Automatic Transmission Fluid

In this experiment, three lubricating compositions are prepared based on the formulation given below which represents a typical or conventional lubricant for an automatic transmission. Each of the components other than the oil is presented in an oil-free basis, and all the percentages are by weight:

Oil of lubricating viscosity: in an amount to total 100%
Borated dispersant: 0.698
Succinimide Dispersant: 0.707
Ester/amide type dispersant containing
DMTD (2,5-dimercapto-1,3,4-thiadiazole: 0.092
Alkenyl imidazolene friction modifier: 0.004
Ethoxylated amine friction modifier: 0.025
Long chain hydroxylamine friction modifier: 0.137
Dialkylhydrogen phosphite antiwear agent/friction modifier: 0.077
Friction adjustor: 0.031
Substituted thiadiazole & triazole corrosion inhibitors, polydimethylsiloxane antifoams, pour point depressant, detergent & antioxidant: 1.133
diluent oil: 4.235

The oil of lubricating viscosity is a blend of 85% by weight of a Group II base oil and 15% by weight of a Group III base oil. In one of the lubricating compositions, 0.75% by weight of compound E is added as shown in Table 7 (Example 4). In one of the lubricating compositions, 1.25% by weight of compound E is added (Example 5). In one of the lubricating compositions, no further additive is added (Reference Example 3).

TABLE 7

| | Oil of lubricating viscosity | Further additive | Amount of further additive (wt %) |
|---|---|---|---|
| Reference Example 3 | 85 wt % Group II/ 15 wt % Group III | None | 0 |
| Example 4 | 85 wt % Group II/ 15 wt % Group III | Compound E | 0.75 |
| Example 5 | 85 wt % Group II/ 15 wt % Group III | Compound E | 1.25 |

In this experiment, the test method is as described for Experiment 1 above and is carried out over a range of elastomers. The results are shown in Table 8. The results show that, at a treat rate of 1.5 wt % each elastomer material swells more (i.e. the percentage increase in volume is greater) when the composition of the invention (Example 5) is used compared to when the composition of Reference Example 3 (no further additive) is used.

TABLE 8

| | | Ref. Ex. 3 | Ex. 4 | Ex. 5 |
|---|---|---|---|---|
| V1 Ethylene acrylic elastomer | Volume change (%) | 5.28 | 7.6 | 9.21 |
| | Hardness change (points) | −2 | −3 | −4 |
| V2 Ethylene acrylic elastomer | Volume change (%) | 3.41 | 3.35 | 5.43 |
| | Hardness change (points) | 0 | 0 | 0 |
| V3 Ethylene acrylic elastomer | Volume change (%) | 6.55 | 8.59 | 10.67 |
| | Hardness change (points) | −2 | −4 | −5 |
| P1 polyacrylate | Volume change (%) | 1.04 | 3.87 | 5.44 |
| | Hardness change (points) | −1 | −1 | −4 |
| P2 polyacrylate | Volume change (%) | 3.57 | 6.69 | 8.14 |
| | Hardness change (points) | 0 | −3 | −5 |
| P3 polyacrylate | Volume change (%) | −3.13 | −0.13 | 1.7 |
| | Hardness change (points) | 4 | 1 | 0 |
| Fl fluoroelastomer | Volume change (%) | 0.85 | 2.27 | 2.77 |
| | Hardness change (points) | 0 | 0 | −1 |
| F2 fluoroelastomer | Volume change (%) | 0.78 | 2.03 | 2.65 |
| | Hardness change (points) | 0 | 1 | 1 |
| Ni nitrile | Volume change (%) | −2.4 | 1.16 | 3.6 |
| | Hardness change (points) | −1 | −3 | −6 |

Experiment 3—Automatic Transmission Fluid

In this experiment, three lubricating compositions are prepared based on the formulation given below which represents a typical or conventional lubricant for an automatic transmission. Each of the components other than the oil is presented in an oil-free basis, and all the percentages are by weight:

Oil of lubricating viscosity: in an amount to total 100%
Viscosity modifier: 1.733
Dialkylhydrogen phosphite antiwear agent/friction modifier: 0.195
Borated dispersant: 0.169
Aminic & phenolic antioxidants: 0.4
Substituted thiadiazole & triazole corrosion Inhibitors: 0.075
PDMS (polydimethylsiloxane)-type antifoams: 0.03
Zinc based antiwear agent: 0.133
Detergent: 0.067
diluent oil: 7.03

The oil of lubricating viscosity is a PAO 4 base oil. In one of the lubricating compositions, 0.75% by weight of compound E is added as shown in Table 9 (Example 6). In one of the lubricating compositions, 1.25% by weight of compound E is added (Example 7). In the third lubricating composition, no further additive is added (Reference Example 4).

TABLE 9

| | Oil of lubricating viscosity | Further additive | Amount of further additive (wt %) |
|---|---|---|---|
| Reference Example 4 | PAO 4 | None | 0 |
| Example 6 | PAO 4 | Compound E | 0.75 |
| Example 7 | PAO 4 | Compound E | 1.25 |

In this experiment, the test method is as described for Experiment 1 above and is carried out over a range of elastomers. The results are shown in Table 10. The results show that the elastomer material swells more (i.e. the percentage increase in volume is greater) when the composition of the invention (Example 6 and Example 7) is used compared to when the composition of Reference Example 4 (no further additive) is used.

TABLE 10

| | | Ref. Ex. 4 | Ex. 6 | Ex. 7 |
|---|---|---|---|---|
| V1 Ethylene acrylic elastomer | Volume change (%) | 3.13 | 5.12 | 6.3 |
| | Hardness change (points) | 0 | −1 | −1 |
| P1 Polyacrylate | Volume change (%) | 0.75 | 2.91 | 4.39 |
| | Hardness change (points) | 1 | −1 | −3 |
| F1 fluoroelastomer | Volume change (%) | 0.86 | 1.67 | 2.34 |
| | Hardness change (points) | −1 | −2 | −3 |
| N1 Nitrile | Volume change (%) | −3.56 | −0.7 | 1.57 |
| | Hardness change (points) | 5 | 1 | 0 |

Experiment 4—Off-Highway Fluid

The efficacy of compounds of formula (I) as seal swell agents is assessed by blending the compounds into one or more typical or conventional lubricants for off-highway application (off-highway fluids are used, for example, for lubricating transmissions, final drives, wet brakes, transmission clutches and/or hydraulic systems in off-highway equipment) and determining the degree of compatibility with elastomeric seal materials as per test methods outlined in ASTM D2240 and ASTM D471. The volume and hardness of the elastomer test pieces are determined and the elastomer test pieces are then aged in the candidate lubricating composition for 100 hours at 100° C. in accordance with ASTM D471. The volume change and Shore A hardness of the test pieces are then determined again.

Two lubricating compositions are prepared based on the formulation given below which represents a typical or conventional lubricant for an off-highway fluid. Each of the components other than the oil is presented in an oil-free basis, and all the percentages are by weight:

Oil of lubricating viscosity: in an amount to total 100%
Ester based or succinimide dispersant(s): 0.291
Ca based detergents: 1.894
ZDDP antiwear agents: 2.553
Ancillary components: 0.336
Diluent oil: 3.405

The ancillary components include antioxidants, pour point depressants, antifoam agents, emulsifiers, etc.

The oil of lubricating viscosity is a Group II base oil. In one of the lubricating compositions, compound E is added as shown in Table 11 (Example 8). In the other lubricating composition, Reference Example 5, no further additive is added.

TABLE 11

| | Oil of lubricating viscosity | Further additive | Amount of further additive (wt %) |
|---|---|---|---|
| Reference Example 5 | Group II | None | 0 |
| Example 8 | Group II | Compound E | 0.2 |

In this experiment, the test method is as described above and is carried out over a range of elastomers. The results are shown in Table 12. The results in Table 12 show that, at this treat rate, the elastomer materials swell more (i.e. the percentage increase in volume is greater) when the composition of the invention (Example 8) is used compared to when the composition of Reference Example 5 (no further additive) is used.

TABLE 12

| | | Reference Example 5 | Example 8 |
|---|---|---|---|
| V1 Ethylene acrylic elastomer | Volume change (%) | 8.13 | 8.6 |
| | Hardness change (points) | −1 | −1 |
| V3 Ethylene acrylic elastomer | Volume change (%) | 9.2 | 10.31 |
| | Hardness change (points) | −2 | −4 |
| P1 polyacrylate | Volume change (%) | 3.51 | 3.95 |
| | Hardness change (points) | 0 | −2 |
| P2 polyacrylate | Volume change (%) | 5.86 | 6.41 |
| | Hardness change (points) | 1 | −1 |
| P3 polyacrylate | Volume change (%) | −0.82 | −0.06 |
| | Hardness change (points) | 7 | 2 |
| F1 fluoroelastomer | Volume change (%) | 0.44 | 0.7 |
| | Hardness change (points) | 1 | −1 |
| F2 fluoroelastomer | Volume change (%) | 0.43 | 0.76 |
| | Hardness change (points) | 2 | 1 |
| N1 nitrile | Volume change (%) | −2.12 | −0.77 |
| | Hardness change (points) | 11 | 6 |

Experiment 5—Off-Highway Fluid

Two lubricating compositions are prepared based on the formulation given below which represents a typical or conventional lubricant for an off-highway fluid. Each of the components other than the oil is presented in an oil-free basis, and all the percentages are by weight:

Oil of lubricating viscosity: in an amount to total 100%
Ester based or succinimide dispersant(s): 0.291
Ca based detergents: 1.424
ZDDP antiwear agents: 2.553
Ancillary components: 0.318
Diluent oil: 2.907

The ancillary components include antioxidants, pour point depressants, antifoam agents, emulsifiers, etc.

The oil of lubricating viscosity is a Group II base oil. In one of the lubricating compositions, compound E is added as shown in Table 13 (Example 9). In one of the lubricating composition, Reference Example 6, no further additive is added.

TABLE 13

| | Oil of lubricating viscosity | Further additive | Amount of further additive (wt %) |
|---|---|---|---|
| Reference Example 6 | Group II | none | 0 |
| Example 9 | Group II | Compound E | 0.2 |

In this experiment, the test method is as described for Experiment 4 is carried out over a range of elastomers. The results are shown in Table 14. The results in Table 14 show that the elastomer material swells more (i.e. the percentage increase in volume is greater) when the composition of the invention (Example 9) is used compared to when the composition of Reference Example 6 (no further additive) is used.

TABLE 14

| | | Reference Example 6 | Example 9 |
|---|---|---|---|
| V1 Ethylene acrylic elastomer | Volume change (%) | 8.47 | 9.03 |
| | Hardness change (points) | −4 | −2 |
| V2 Ethylene acrylic elastomer | Volume change (%) | 4.95 | 6.57 |
| | Hardness change (points) | 0 | 1 |
| V3 Ethylene acrylic elastomer | Volume change (%) | 9.81 | 11.08 |
| | Hardness change (points) | −3 | −3 |
| P1 polyacrylate | Volume change (%) | 3.47 | 4.06 |
| | Hardness change (points) | −2 | 0 |
| P2 polyacrylate | Volume change (%) | 5.99 | 6.84 |
| | Hardness change (points) | −1 | 0 |
| P3 polyacrylate | Volume change (%) | −0.94 | 0.45 |
| | Hardness change (points) | 2 | 5 |
| F1 fluoroelastomer | Volume change (%) | 0.28 | 0.75 |
| | Hardness change (points) | 0 | 1 |
| F2 fluoroelastomer | Volume change (%) | 0.19 | 0.69 |
| | Hardness change (points) | 0 | 3 |
| N1 nitrile | Volume change (%) | −1.65 | −0.61 |
| | Hardness change (points) | 0 | −2 |

Experiment 6—Off-Highway Fluid

Two lubricating compositions are prepared based on the formulation given below which represents a typical or conventional lubricant for an off-highway fluid. Each of the components other than the oil is presented in an oil-free basis, and all the percentages are by weight:

Oil of lubricating viscosity: in an amount to total 100%
Ester based or succinimide dispersant(s): 1.000
Ca based detergents: 1.087
ZDDP antiwear agents: 1.152
Ancillary components: 0.321
Diluent oil: 2.476

The ancillary components include antioxidants, pour point depressants, antifoam agents, emulsifiers, etc.

The oil of lubricating viscosity is a Group II base oil. In one of the lubricating compositions, compound E is added as shown in Table 15 (Example 10). In the other lubricating composition, Reference Example 7, no further additive is added.

TABLE 15

| | Oil of lubricating viscosity | Further additive | Amount of further additive (wt %) |
|---|---|---|---|
| Reference Example 7 | Group II | none | 0 |
| Example 10 | Group II | Compound E | 0.2 |

In this experiment, the test method is as described for Experiments 4 and 5 above. The results are shown in Table 16. The results in Table 16 show that, at this treat rate, most of the elastomer materials swell more (i.e. the percentage increase in volume is greater) when the composition of the invention (Example 10) is used compared to when the composition of Reference Example 7 (no further additive) is used.

TABLE 16

| | | Reference Example 7 | Example 10 |
|---|---|---|---|
| V1 Ethylene acrylic elastomer | Volume change (%) | 1.79 | 2.8 |
| | Hardness change (points) | 2 | 0 |
| V2 Ethylene acrylic elastomer | Volume change (%) | −0.36 | 1.66 |
| | Hardness change (points) | 3 | 3 |
| V3 Ethylene acrylic elastomer | Volume change (%) | 3.12 | 3.92 |
| | Hardness change (points) | 1 | −1 |
| P1 polyacrylate | Volume change (%) | −0.32 | 0.31 |
| | Hardness change (points) | 2 | 0 |
| P2 polyacrylate | Volume change (%) | 1.51 | 2.15 |
| | Hardness change (points) | 2 | 1 |
| P3 polyacrylate | Volume change (%) | −4.38 | −3.59 |
| | Hardness change (points) | 7 | 5 |
| F1 fluoroelastomer | Volume change (%) | 0.46 | 0.55 |
| | Hardness change (points) | 0 | 1 |
| N1 nitrile | Volume change (%) | −4.36 | −3.1 |
| | Hardness change (points) | 2 | −1 |

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements. As used herein, the term "comprising" is intended also to encompass as alternative embodiments "consisting essentially of" and "consisting of." "Consisting essentially of" permits the inclusion of substances that do not materially affect the basic and novel characteristics of the composition under consideration.

What is claimed is:

1. A composition comprising an oil of lubricating viscosity and a compound represented by formula (I)

(I)

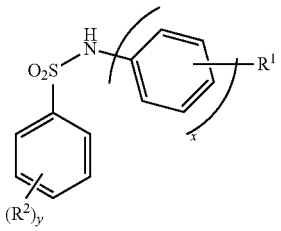

wherein: x is 0; $R^1$ is a hydrocarbyl group containing 6 to about 18 carbon atoms; $R^2$ is an aliphatic hydrocarbyl group containing 1 to about 12 carbon atoms; and y is 0; and the oil of lubricating viscosity is a Group II, Group III, Group IV or Gas-to-Liquid (Fischer-Tropsch) base oil, or mixture thereof; and wherein the compound of formula (I) is present in the composition in an amount of from 0.15 to 2 wt %; and wherein the oil of lubricating viscosity is present in the composition in an amount of greater than 50 wt %.

2. The composition according to claim 1, wherein $R^1$ is an aliphatic hydrocarbyl group containing about 6 to about 12 carbon atoms.

3. The composition according to claim 1, wherein $R^1$ is a branched or linear alkyl or alkenyl group.

4. The composition according to claim 3, wherein $R^1$ is selected from the group consisting of n-hexyl, heptyl, 2-ethylhexyl, isooctyl, octyl, nonyl, decyl, dodecyl, tetradecyl, hexadecyl, octadecyl and, 9-octadecenyl.

5. The composition according to claim 1, wherein the composition comprises one or more components selected from the group of dispersants, detergents, metal salts of a phosphorus acid, friction modifiers, viscosity modifiers and antioxidants.

6. The composition according to claim 1, wherein the composition is a lubricant for a driveline device or an internal combustion engine.

7. The composition according to claim 1, wherein the composition is a lubricant for a gas compressor or a refrigeration system.

8. A method of lubricating a mechanical device which has a seal in contact with a lubricating composition, said method comprising supplying to said device a composition according to claim 1.

9. The method according to claim 8, wherein the mechanical device is a driveline device or an internal combustion engine.

10. The method according to claim 8, wherein the mechanical device is a gas compressor or a refrigeration system.

11. The method according to claim 8, wherein the seal is an elastomer.

12. A method of swelling an elastomer seal when in contact with a lubricating composition, said method comprising contacting the elastomer seal with the composition of claim 1.

13. The method according to claim 12, wherein the seal is an elastomer chosen from an ethylene acrylic elastomer, a fluoroelastomer, a chloroelastomer, a polyacrylate and a nitrile polymer.

14. The method according to claim 12, wherein the lubricating composition is an automatic transmission fluid, an off-highway lubricant, an axle gear oil, or an engine oil.

15. The method according to claim 12, wherein the lubricating composition is a gas compressor lubricant or a lubricant for a refrigeration system.

* * * * *